US010851798B2

(12) United States Patent
Conley et al.

(10) Patent No.: US 10,851,798 B2
(45) Date of Patent: Dec. 1, 2020

(54) DEPLOYABLE FAN WITH LINEAR ACTUATOR

(71) Applicant: Swiss Module Group LLC, Santa Monica, CA (US)

(72) Inventors: William P. Conley, Long Beach, CA (US); Rodger D. Thomason, Santa Monica, CA (US); Ricardo Garivaldo Lopez, Fontana, CA (US)

(73) Assignee: SWISS MODULE GROUP LLC, Santa Monica, CA (US)

( * ) Notice: Subject to any disclaimer, the term of this patent is extended or adjusted under 35 U.S.C. 154(b) by 149 days.

(21) Appl. No.: 16/168,342

(22) Filed: Oct. 23, 2018

(65) Prior Publication Data

US 2019/0120247 A1 Apr. 25, 2019

Related U.S. Application Data

(60) Provisional application No. 62/575,890, filed on Oct. 23, 2017.

(51) Int. Cl.
*F04D 29/36* (2006.01)
*F04D 25/08* (2006.01)

(52) U.S. Cl.
CPC ..... *F04D 29/364* (2013.01); *F04D 25/088* (2013.01)

(58) Field of Classification Search
CPC ..... F04D 29/364; F04D 25/088; F16H 25/20
See application file for complete search history.

(56) References Cited

U.S. PATENT DOCUMENTS 1,445,402 A * 2/1923 Le Velle ..... F04D 29/364 416/87
3,692,427 A * 9/1972 Risse ..... B01F 7/00058 416/143
5,154,579 A 10/1992 Rezek
6,503,167 B1 * 1/2003 Sturm ..... F16H 48/22 192/84.6
7,153,100 B2 * 12/2006 Frampton ..... F04D 25/088 416/5
7,857,591 B2 * 12/2010 Gajewski ..... F24F 7/007 415/129
8,292,585 B2 * 10/2012 Liu ..... F04D 29/36 416/140
8,317,470 B2 * 11/2012 Villella ..... F24F 7/007 416/5
8,790,085 B2 * 7/2014 Villella ..... F04D 25/08 416/140

(Continued)

FOREIGN PATENT DOCUMENTS

JP 59-197747 11/1984

*Primary Examiner* — Kenneth J Hansen
*Assistant Examiner* — Brian O Peters
(74) *Attorney, Agent, or Firm* — Cislo & Thomas, LLP

(57) ABSTRACT

A linear actuator for use with a fan with deployable fan blades to deploy the fan blades when in use and stow the fan blades when not in use. The linear actuator utilizes a drive element having a driver that moves linearly along a shaft of the linear actuator. Linear movement of the driver causes radial movement of arms connected to the linear actuator and the fan blades. Radial movement of the arms causes rotational movement of gears attached to the ends of the fan blades to cause the fan blades to rotate into the deployed or stowed configuration.

10 Claims, 22 Drawing Sheets

(56) References Cited

U.S. PATENT DOCUMENTS

| | | | | |
|---|---|---|---|---|
| 8,851,841 | B2 * | 10/2014 | Care | F04D 29/366 416/5 |
| 8,864,463 | B2 * | 10/2014 | Conley | F04D 29/364 416/1 |
| 2004/0253104 | A1 * | 12/2004 | Liu | F04D 25/088 416/48 |
| 2008/0286103 | A1 | 11/2008 | Gajewski et al. | |
| 2008/0286105 | A1 | 11/2008 | Gajewski et al. | |
| 2009/0074587 | A1 | 3/2009 | Goswami | |
| 2013/0084180 | A1 | 4/2013 | Conley et al. | |
| 2018/0128277 | A1 | 5/2018 | Chia | |
| 2019/0120247 | A1 | 4/2019 | Conley et al. | |

* cited by examiner

DEPLOYABLE FAN WITH LINEAR ACTUATOR

CROSS-REFERENCE TO RELATED APPLICATION

This patent application claims the benefit of U.S. Provisional Patent Application Ser. No. 62/575,890, entitled "Deployable Fan with Linear Actuator," filed Oct. 23, 2017, which application is incorporated in its entirety here by this reference.

BACKGROUND

The basic powered blade deployment of a ceiling fan is covered by U.S. Pat. No. 7,857,591 B2, which is incorporated in its entirety here by this reference. The individual fan blades are mounted to a rotating platform that is powered by a main fan motor. Development of the technology for commercial use has depended upon a good solution for transmitting controllable power to this rotating platform, for precisely actuating the fan blades.

Initial designs used one or more electric motors on the rotating platform to actuate the blades. This relied on a rotating electrical interface, or slip ring. This approach is lacking because slip rings tend to be expensive and wear out too quickly for the expected life of a ceiling fan. There is also a problem with coordinating the deployment of the blades, and with corrosion of the slip ring contacts during typical long periods when the fan is not used.

A first approach to an alternative power source for the blades is described in our second patent—U.S. Pat. No. 8,864,463 B2, which is incorporated in its entirety here by this reference. This approach uses the main fan motor mounted to a planetary gear set. When the planetary gears are locked, the fan rotates as a unit. When the planetary gears are unlocked, the rotating platform can be locked and the main motor planet carrier drives the blade deployment and retraction in a coordinated fashion. This approach has proven to work, but is difficult to implement into a commercial product. The required clutches are noisy, prone to wear, and difficult to control accurately. Coordinating the main motor speed in all conditions in order to ensure smooth blade action has been a challenge with this design. In short, this approach has not given the quality experience customers would expect from a high-end ceiling fan.

SUMMARY OF THE INVENTION

After the main motor/planetary gear drive experience, extensive research resulted in a blade actuation solution that accomplishes the following objectives: low cost, durable, low energy consumption (Energy Star rating is desirable in the industry), plenty of power to actuate blades of various sizes, good coordination and control of blades, low or minimal adjustments over the life of the product, easy to operate as part of a normal ceiling fan remote control, excellent sound quality in line with a high-end product, no rotating electrical interface, compact size to allow for a variety of housing designs.

The new fan actuator and structure described here meets all of these requirements by coupling radial deployment of fan blades using a linear actuator while the fan blades or rotating. The fan blades can further be pitched up during deployment. When the fan is turned off and the fan blades return to their stowed configuration, the fan blades automatically pitch down until flat as the fan blades retract radially back into a housing.

DETAILED DESCRIPTION OF THE INVENTION

Figure 1:
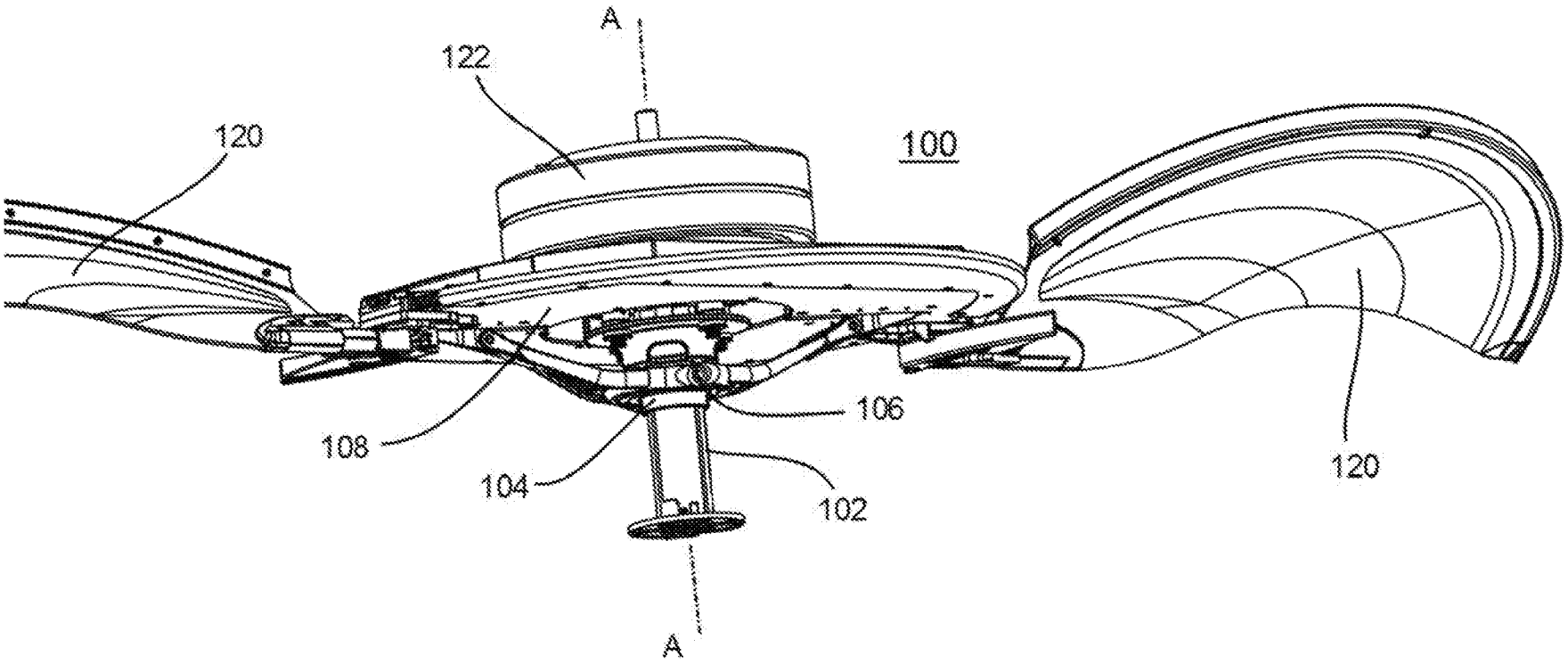
FIG. 1 is a perspective view of an embodiment of the present invention in the deployed configuration with the housing removed to show the internal components.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The invention of the present application is a system and method of automatically deploying and stowing one or more fan blades 120 by moving a carriage 104 in a first linear direction along a linear actuator 102 mounted to a fan motor 122, wherein the carriage 104 is operatively connected to the fan blade to rotate with the fan blade 120. Moving the carriage 104 in the first linear direction converts the linear movement of the carriage 104 in the first linear direction into movement of the fan blade 120 in a first radial direction away from the linear actuator, and moving the carriage 104 in a second linear direction along the linear actuator 104, opposite the first linear direction converts the movement of the carriage in the second linear direction into movement of the fan blade in a second radial direction towards the linear actuator. In some embodiments, movement of the fan blade in the first radial direction pitches the fan blade up; and movement of the fan blade in the second radial direction pitches the fan blade down. In some embodiments, movement of the carriage in the first linear direction causes housing sections 138*a*, 138*b* of a housing 138 to separate and reveal the fan blade 120; and movement of the carriage 104 in the second linear direction causes the housing sections 138*a*, 138*b* to mate together to hide the fan blade 120 inside the housing.

As shown in FIG. 1, the fan 100 of the present invention comprises a fan platform 108 defining a central axis A, and a linear actuator 102 operatively connected to the fan platform 108 and aligned substantially with the central axis A of the fan platform 108. The fan platform 108 comprises at least one fan blade 120 having a proximal end 142 and a distal end 143. The actuator 102 moves a carriage 104 in both directions along the central axis A. The carriage 104 is operatively connected to the fan blade 120, preferably at the proximal end 142, and configured so that movement of the carriage 104 along the central axis A in one direction causes the fan blade 120 to deploy and movement of the carriage 104 along the central axis A in a second direction, opposite the first direction, causes the fan blade 120 to move towards a stowed configuration in which the fan blade 120 is at least partially hidden within a housing 138. By use of an anti-friction bearing 106, it is possible to rigidly mount the actuator 102 in place while allowing the movable carriage 104 to rotate with a fan platform 108 about the actuator 102. This configuration allows the fan blades 120 to deploy simultaneously as the fan blades rotate.

Figure 2:
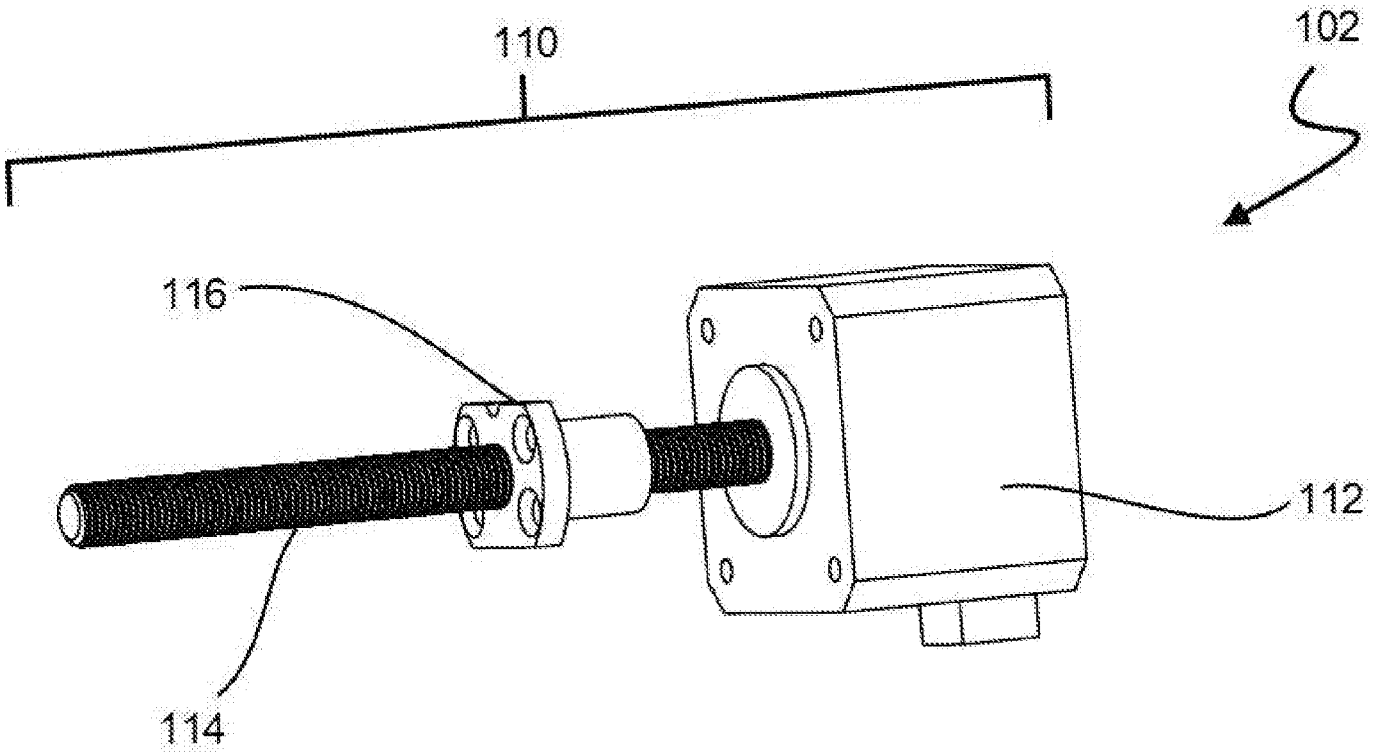
FIG. 2 is a perspective view of the drive mechanism for the linear actuator.

As shown in FIG. 2, the linear actuator 102 comprises a drive element 110. In the preferred embodiment, the drive element 110 comprises a motor 112, such as a stepper motor, servo motor, dc motor, and the like, and a shaft 114 operatively connected to the motor 112, such that the motor causes rotation of the shaft 114. Preferably, the shaft 114 is a threaded shaft defining a longitudinal axis L. A driver 116, such as a lead screw nut, is mounted on the shaft 114, such that the shaft 114 can move the driver 116. For example, rotation of the driver 116 about the shaft 114 in a first direction may cause the driver 116 to move in a first linear direction along the shaft 114, and rotation of the driver 116 about the shaft 114 in a second direction, opposite the first direction, causes the driver 116 to move in a second linear direction along the shaft 114 opposite the first linear direction. The driver 116 is connected to the carriage 104 so that movement of the driver 116 is transferred to movement of the carriage 104. Therefore, actuation of the motor 112 causes rotation of the shaft 114 in the first direction. If the driver 116 is prevented from rotating with the shaft 114, the driver 116 moves in the first linear direction. Because the driver 116 is attached to the carriage 104, the carriage 104 also moves in the first linear direction. Actuation of the motor 112 in the opposite direction causes the shaft 114 to rotate in the second direction. If the driver 116 is prevented from rotating with the shaft 114, the driver 116 moves in the second linear direction. Because the driver 116 is attached to the carriage 104, the carriage 104 also moves in the second linear direction.

These units are easily controlled, provide substantial force at various speeds, and have pleasing sound quality. In the preferred embodiment, less than 10 watts of electrical power is required to completely deploy and retract fan blades 120, including a fan blade with a 58 inch diameter. Most importantly, the drive element is inexpensive, readily available, and has a service life over 1 million actuation cycles. This life is essentially infinite in a fan deployment application.

With the actuator 102 rigidly mounted on the central axis A of the fan 100 and driving a rotatable carriage 104 up and down along the central axis A of the fan 100, it is necessary to transmit that carriage motion into movement of fan blades 120. In the preferred embodiment, this is accomplished by operatively connecting the carriage 104 to the fan platform 108 to convert the vertical motion of the carriage 104 into a radial motion of the fan blades 120 towards and away from the central axis A of the fan 100. For example, the carriage is operatively connected to the fan platform to convert movement of the carriage in a first linear direction into movement of the fan blade in a first radial direction away from the central axis, and to convert movement of the carriage in a second linear direction, opposite the first linear direction, into movement of the fan blade in a second radial direction towards the central axis.

Figure 3:
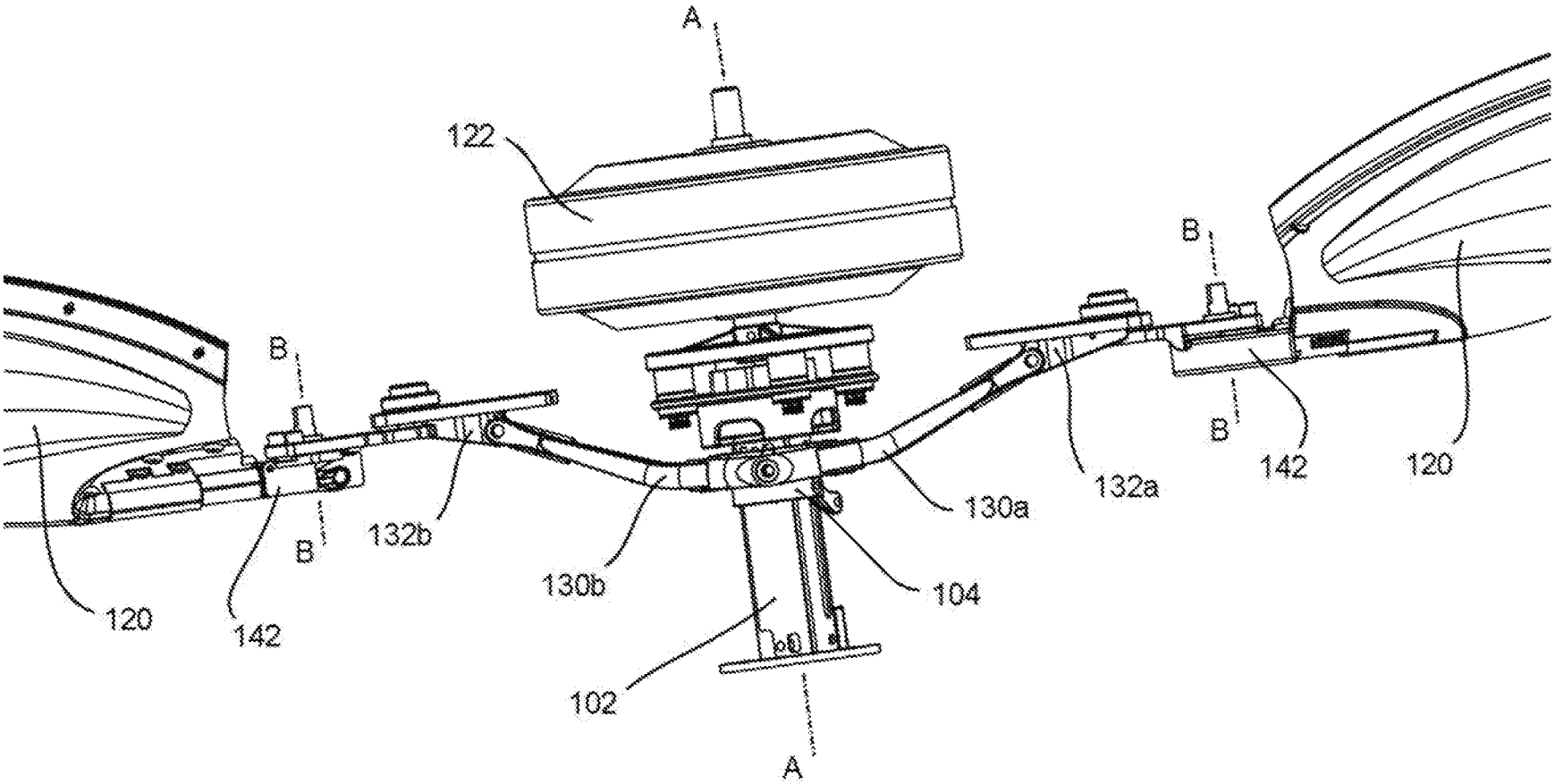
FIG. 3 is a side view in the deployed configuration with the housing removed to show the internal components.
Figure 4:
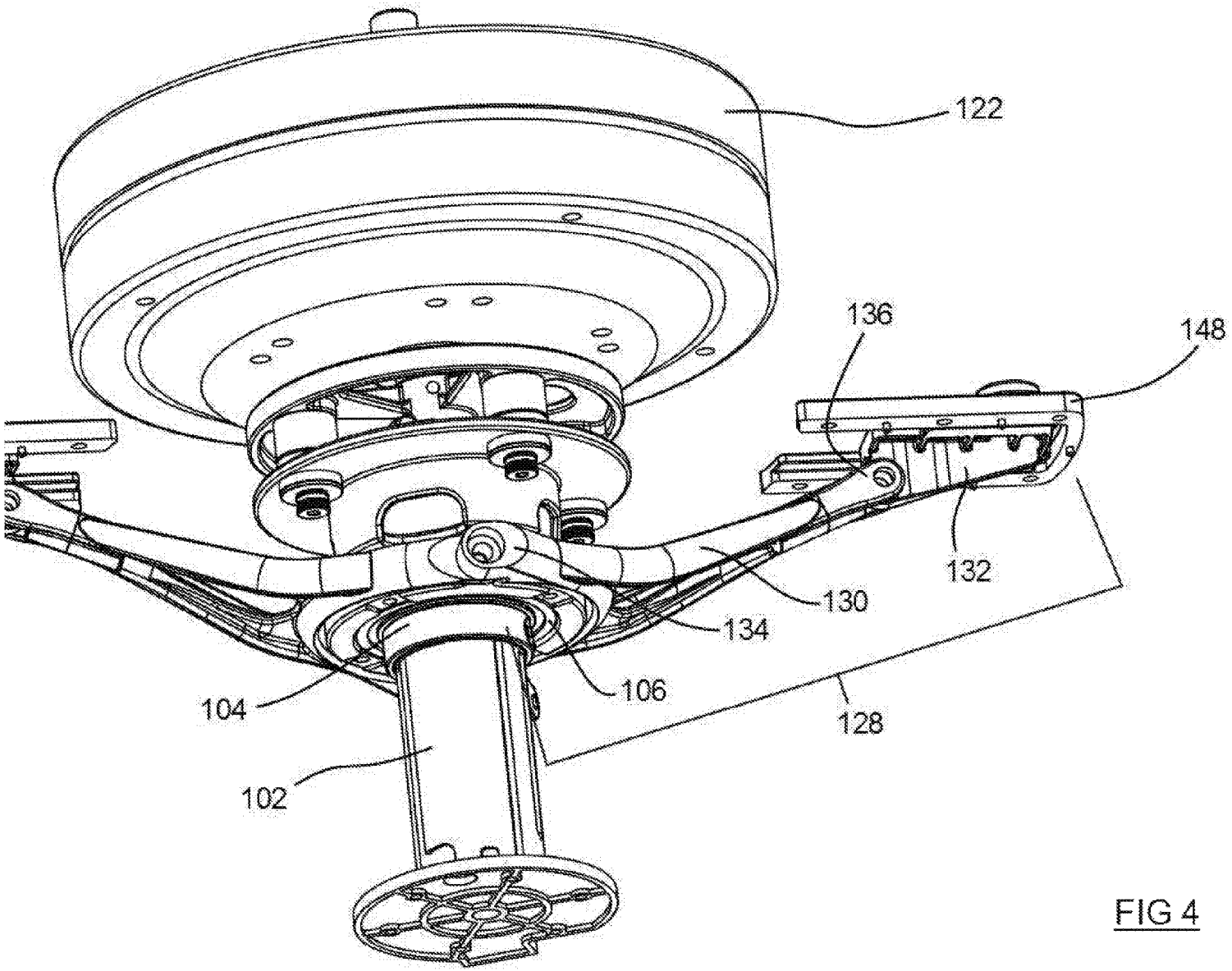
FIG. 4 is perspective view from the bottom in the deployed configuration with the housing and the fan blades removed.
Figure 5:
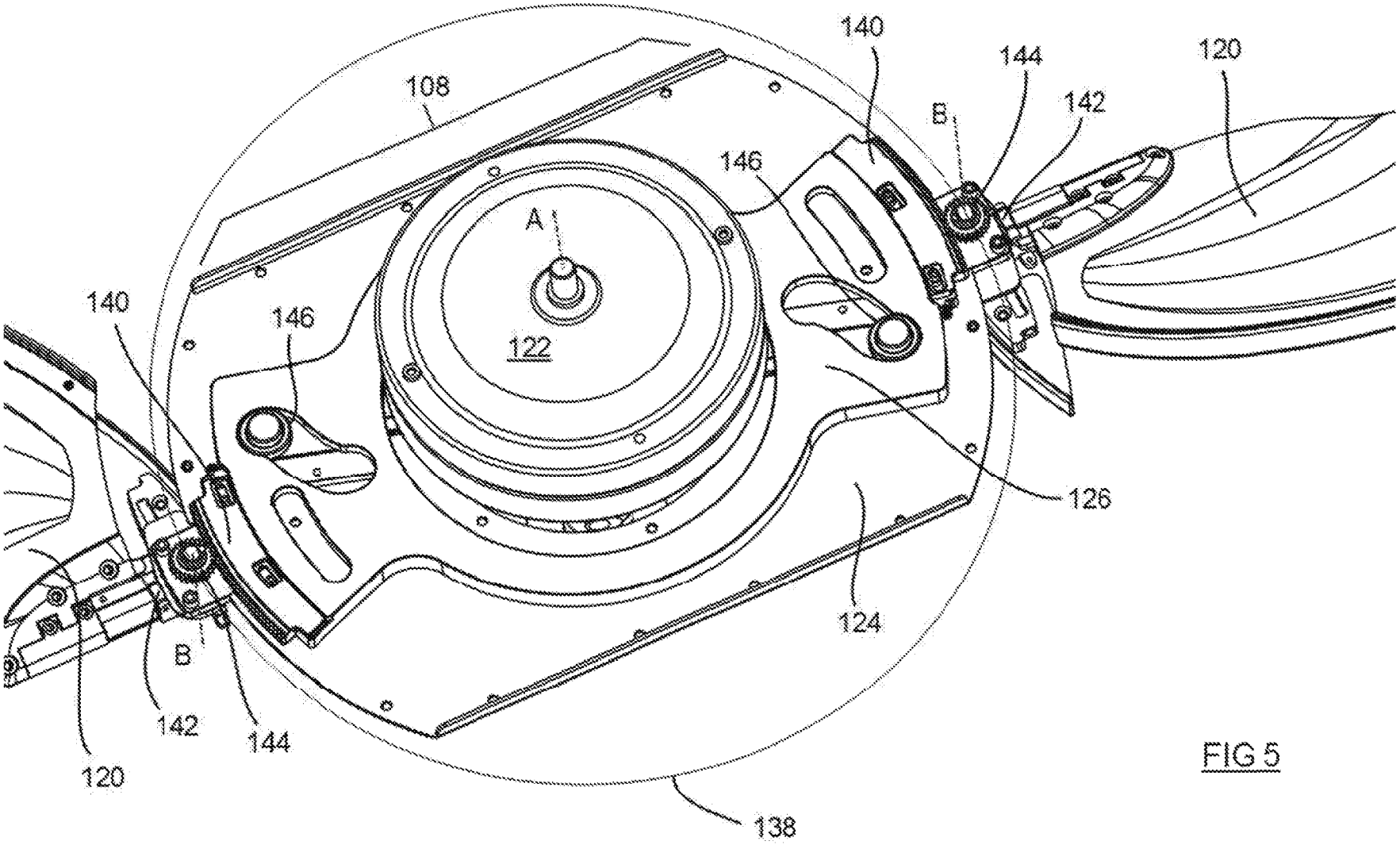
FIG. 5 is a top perspective view of the internal components of an embodiment of the present invention in the deployed configuration.

With reference to FIGS. 3-5, the fan platform 108 comprises a fan motor 122, a fan plate 124 that is driven by the fan motor 122, a rotary drive plate 126 mounted on the fan plate 124 and configured to rotate along a face of the fan plate 124, and a deployment system 128 operatively connected to the fan blades 120. The fan motor 122 is operatively connected to the fan plate 124 to cause the fan plate 124 to rotate about the central axis A. The fan plate 124 is operatively connected to the fan blades 120. Therefore, rotation of the fan plate 124 causes rotation of the fan blades 120. The rotary drive plate 126 being mounted on the fan plate 124 also rotates with the fan plate 124 and fan blades 120; however, the rotary drive plate 126 is also independently movable relative to the fan plate 124. Thus, the rotary drive plate 126 can rotate independently of the fan plate 124 about the central axis. This independent rotational movement of the rotary drive plate 126, along with the deployment system, accounts for the deployment and stowing of the fan blades 120.

The deployment system 128 comprises an arm 130 and a sliding block 132. The arm 130 comprises a first end 134 and a second end 136 opposite the first end 134. The first end 134 of the arm 130 is connected to the carriage 104 and the second end 136 of the arm is connected to the sliding block 132. The number of arms 130 and sliding block 132 are determined by the number of fan blades 120. Each fan blade 120 would have associated with it, one arm 130 and one sliding block 132. Therefore, for a two-blade fan as shown in the figures, there would be two arms 130*a*, 130*b* and two sliding blocks 132*a*, 132*b*. For ease of description, deployment of a single fan blade 120 will be described. Based on the description, a person of ordinary skill in the art will know how to implement the concepts with multiple fan blades 120.

As shown in FIGS. 3-5, the arm 130 is operatively connected to the fan plate 124 and the rotary drive plate 126 via the sliding block 132. The sliding block 132 rotates with the fan plate 124. Note that the attachment of the arm 130 to the sliding block 132 causes the arm 130 to rotate synchronously with the fan plate 124. The anti-friction bearing 106 provided in the carriage 104 allows this rotation to occur while the actuator 102 stays still. Linear movement of the carriage 104 along the linear actuator 102 causes the sliding block 132 to move radially towards or away from the central axis A.

The arrangement of the components as shown in FIGS. 1-5 allows a fixed actuator 102 to create usable motion on the rotating fan plate 124, independent of fan speed, while avoiding a rotating electrical interface.

Figure 6:
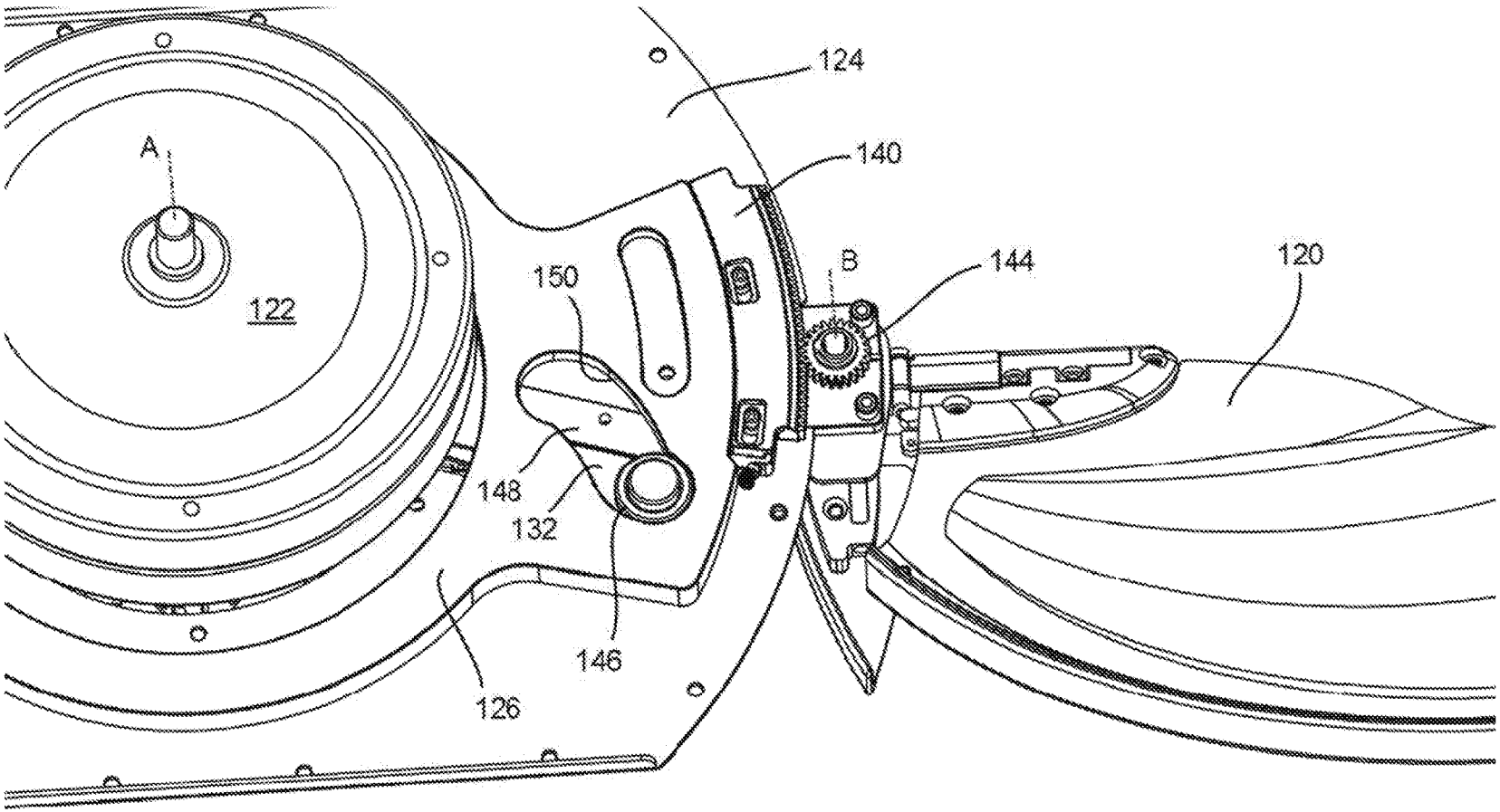
FIG. 6 is a close up, top perspective view of the components involved in the deployment of the fan blades, in the deployed configuration.
Figure 7:
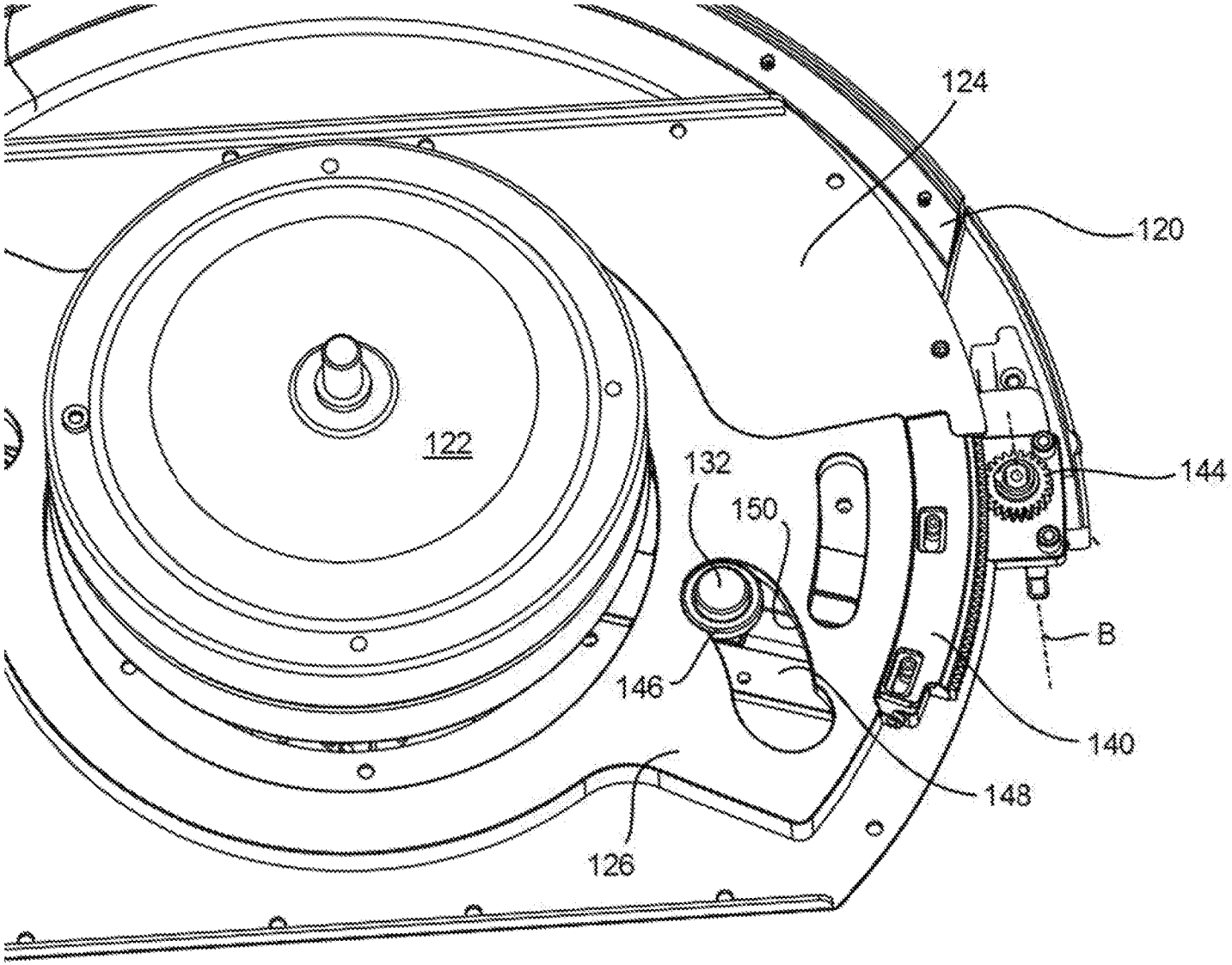
FIG. 7 is the view in FIG. 6, except in the stowed configuration.

As shown in FIGS. 5-7, to achieve deployment and storage of the fan blade 120, in the preferred embodiment, each blade 120 rotates about its own blade pivot axis B near a proximal end 142 of the fan blade 120, near the location where the fan blade 120 is connected to the fan plate 124. Thus, it is necessary to translate the radial sliding motion of the sliding block 132 into a rotational motion at the fan blade pivot axis B.

In the preferred embodiment, each fan blade 120 can rotate approximately 180 degrees, through a plane perpendicular to the central axis A, from a fully stowed position in the fan housing 138 to a fully deployed position with the fan blade 120 extended away from the housing 138. A gear arrangement is employed for this purpose. The rotary drive plate 126 is mounted on the fan plate 124 in a manner that permits the rotary drive plate 126 to pivot about the central axis A, relative to the rotating fan plate 124. A sector gear 140 is mounted to the rotary drive plate 126 at its periphery. At a proximal end 142 of the fan blade 120 is a driving spur gear 144. The driving spur gear 144 is attached to the proximal end 142 of the fan blade such that rotation of the driving spur gear 144 causes rotation of the fan blade 120 about the blade's pivot axis B. Therefore, as the driving spur gear 144 rolls along the sector gear 140 in a first direction, the fan blade 120 rotates about its blade pivot axis B in a first rotational direction causing the blade 120 to deploy. As the driving spur gear 144 rolls along the sector gear 140 in a second direction, opposite the first direction, the fan blade 120 rotates about its blade pivot axis B in a second rotational direction, opposite the first rotational direction, causing the fan blade 120 to move towards a stowed configuration.

The method used in the preferred embodiment to translate the sliding block 132 motion into motion of the rotary drive plate 126 (relative to the main rotating fan plate 124) is very important. Special drive slots are provided in the rotary drive plate 126 and the fan plate 124 that engages the sliding block 132 via a drive roller 146.

Referring to FIGS. 6 and 7, the fan plate 124 is provided with a fan plate drive slot 148 and the rotary drive plate 126 is provided with a rotary plate drive slot 150. The fan plate drive slot 148 has a linear or box-like configuration creating a straight path, whereas the rotary drive plate drive slot 150 has an offset configuration relative to the fan plate drive slot 148. Therefore, the rotary drive plate 126 is mounted on top of the fan plate 124 in such a manner that only a portion of the rotary plate drive slot 150 overlaps with a portion of the fan plate drive slot 148. As such, the drive roller 146 can be inserted through the fan plate drive slot 148 and the rotary plate drive slot 150. Therefore, properly configured, the sliding block 132 resides in the fan plate drive slot 148 to move linearly within the fan plate drive slot 148 in a direction radially towards or away from the central axis A, and the drive roller 146 resides in the rotary plate drive slot 150 to move along the rotary plate drive slot 150.

With reference to FIGS. 6 and 7, because the remaining portions of the rotary plate drive slot 150 is offset from portions of the fan plate drive slot 148, and because the rotary drive plate 126 is rotatably mounted on the fan plate 124, linear movement of the sliding block 132 along the fan plate drive slot 148 causes linear movement of the drive roller 146. The rotary drive plate 126, in order to keep a portion of the rotary plate drive slot 150 aligned with the fan plate drive slot 148, rotates either clockwise or counter-clockwise relative to the fan plate 124. Because the sector gear 140 is attached to the perimeter edge of the rotary drive plate 126, the sector gear 140 moves with the rotary drive plate 126. Movement of the sector gear 140 causes rotation of the spur gear 144 which in turn causes the fan blade 120 to rotate about the blade pivot axis B causing the fan blade to deploy or become stowed depending on the direction of movement.

For example, FIG. 7 shows the sliding block 132 moved to the innermost position (radially inward) on the fan plate 124. The drive roller 146 engages the rotary plate drive slot 150 to turn the rotary drive plate 126 in the blade retract direction.

The shape of the rotary plate drive slot 150 in the rotary drive plate 126 is very important for smooth blade deployment. It is desirable for the blades 120 to start deploying slowly, then pick up to a steady speed until near the end of the motion. Critically, at the end of blade deployment the speed should drop to zero so that the mechanism has infinite mechanical advantage in the blade open position. This serves to "lock out" the blades in the fixed open position.

It is important to have the blades 120 accurately positioned in the full open position while the fan is running, or balance will be compromised. Giving the mechanism infinite mechanical advantage in the deployed position also reduces the actuator arm forces to near zero. This prevents unbalanced side loading of the actuator carriage 104 and allows tolerances/slack to be easily taken up.

Figure 8:
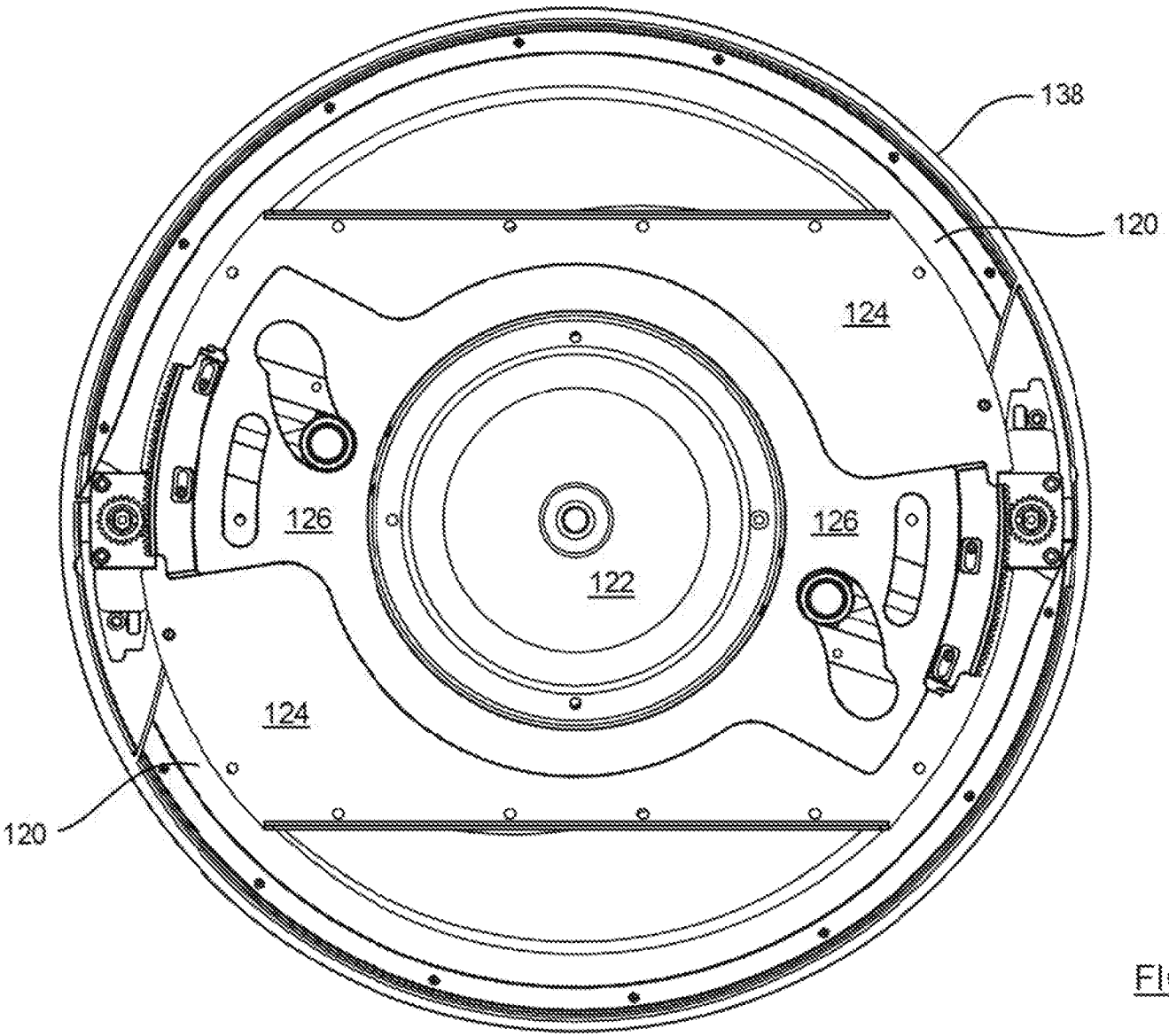
FIG. 8 is a top view in the stowed configuration with the housing removed to show the internal components.

Another important function of the large rotary drive plate 126 is that it can coordinate the deployment of two (or more) blades 120. Without a means of coordination, the arms can push the slide blocks 132 in an unbalanced manner, creating jerky uneven motion of the deploying fan blades. FIG. 8 shows how the rotary drive plate 126 spans both sides of the fan to connect and coordinate the motion of the two blades. Note that three or more blades may be actuated with a similar construction.

Figure 9:
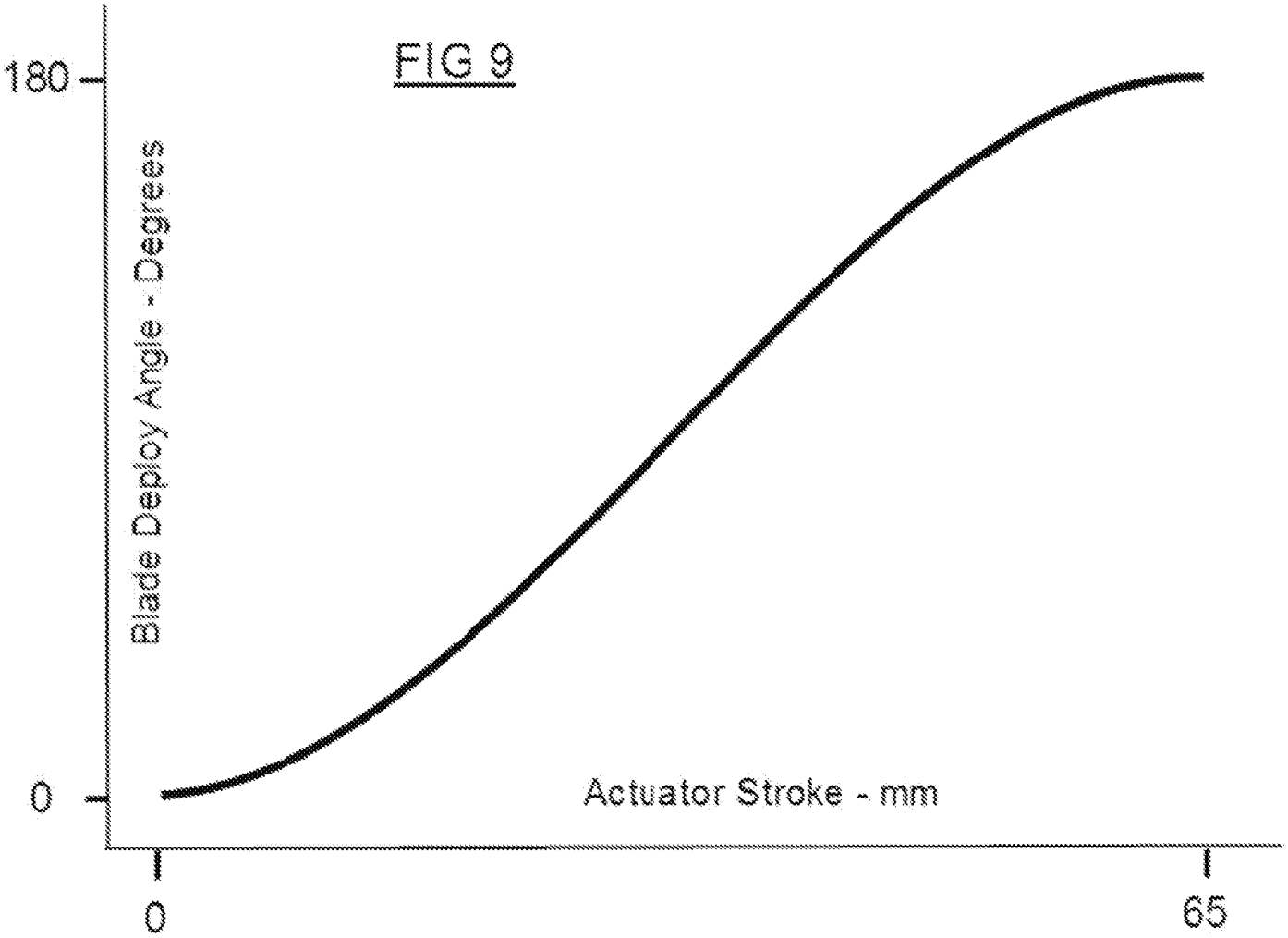
FIG. 9 is a graph showing the relationship of the blade deployment angle with respect to the actuator stroke (distance the carriage moves along the linear actuator).

Referring back to the rotary plate drive slot 150 of FIGS. 5-8, a preferred blade motion profile is shown in FIG. 9. The shape of the rotary plate drive slot 150 is derived from the length of the actuator 102, the kinematics of the arms 130, the location of the sliding blocks 132, and the distance of the blade pivot axis B from the center axis A of the fan. A preferred rotary plate drive slot 150 profile will give a blade displacement curve similar to that of FIG. 9.

Figure 10:
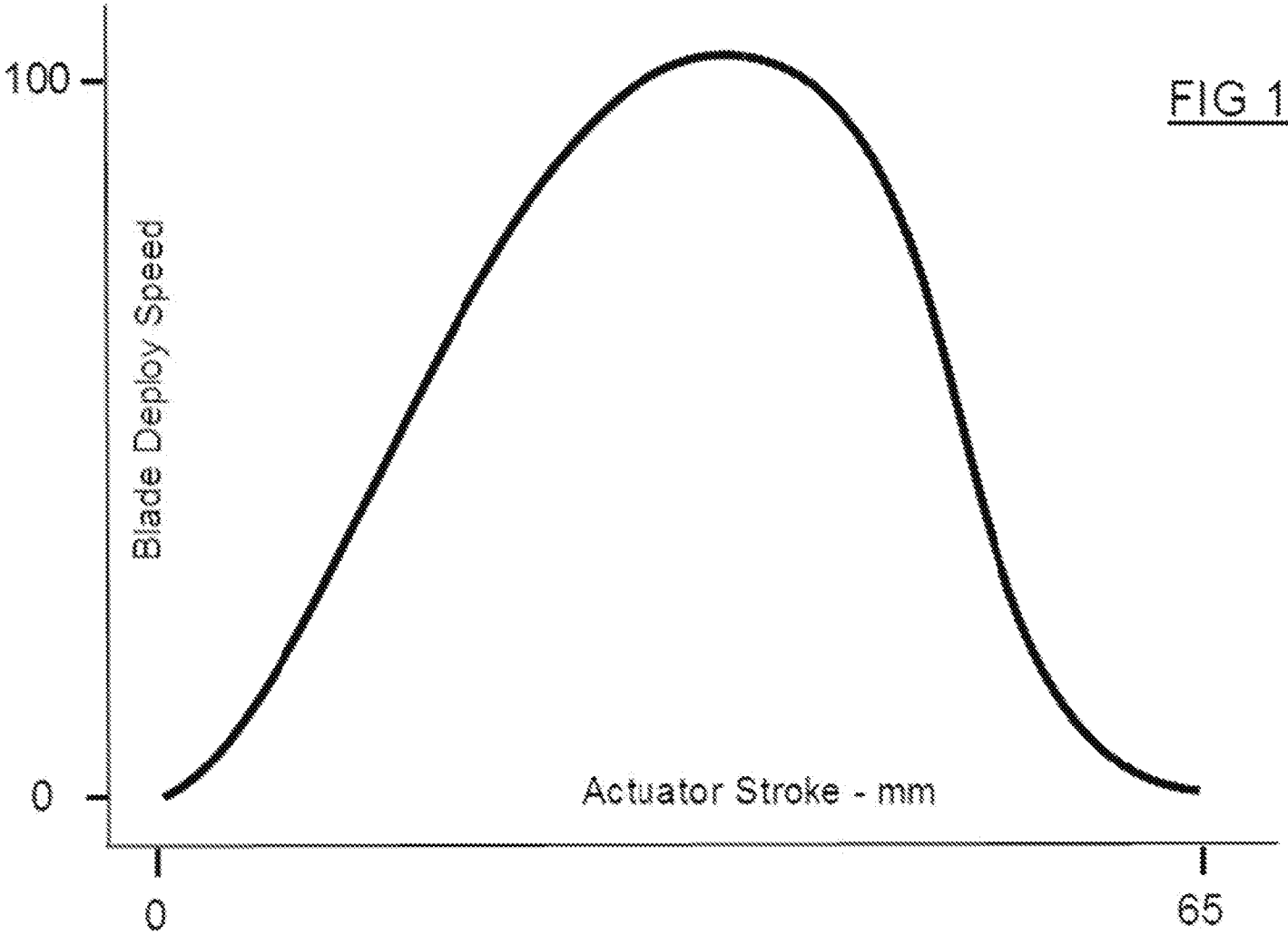
FIG. 10 is a graph showing the relationship of the blade deployment speed with respect to the actuator stroke.

The same preferred drive slot shape will give a blade speed curve vs. actuator position shown in FIG. 10. Note that the speed settles down near zero as the blade 120 reaches its full deployed position. This gives maximum (near infinite) mechanical advantage to the mechanism in order to lock out the blades 120 while minimizing compression loads on the arms 130.

The new blade deployment mechanism described above fulfills the "wish list" for a high-end deployable blade ceiling fan. The mechanism is powerful, quiet, and smooth. In the preferred embodiment it uses less than 10 watts of electrical energy to move the blades and has shown greater than 25 years life expectancy in normal service. The structure is compact, allowing for aggressive housing designs and it lends itself to low-cost manufacturing methods. Many of the parts will be made from molded reinforced plastics, for example.

The blades 120 are stowed inside the housing 138 in a "flat" configuration, for minimum use of space. In other words, the plane of each blade surface 121 is substantially perpendicular to the fan center axis A when in the stowed position. In order for the blades 120 to move air when the fan is turning, the blades must be "pitched up" to a predetermined angle relative to the fan center axis A, when in the deployed position. It is important that the blade pitch angle be accurate and repeatable over the life of the fan, or aerodynamic imbalances will occur while the fan is running. It is also important that the blade pitch mechanism be strong and robust, to resist damage from blade impacts or abuse.

In order for a ceiling fan to blow air towards the user effectively, the fan blades should be angled relative to the central axis A. In other words, the fan blade 120 should have a pitch. The fan blade 120 comprises a leading edge 152 and a trailing edge 154. The leading edge 152 leads the fan blade 120 during the rotation and the trailing edge 154 follows the rotation. It is understood that the rotation of the fan blades 120 can be reversed and so the leading edge 152 can become the trailing edge 154 and vice versa. However, for purposes of this discussion, only one direction of rotation will be discussed with the leading edge 152 designating the edge of the fan blade 120 that leads the rotation. With this understanding, when the fan 100 is deployed, the fan blade 120 should have a pitch such that the leading edge 152 is elevated above the trailing edge 154. When the fan 100 is in the stowed configuration, the leading edge 152 and the trailing edge 154 are substantially within the same plane.

Figure 11:
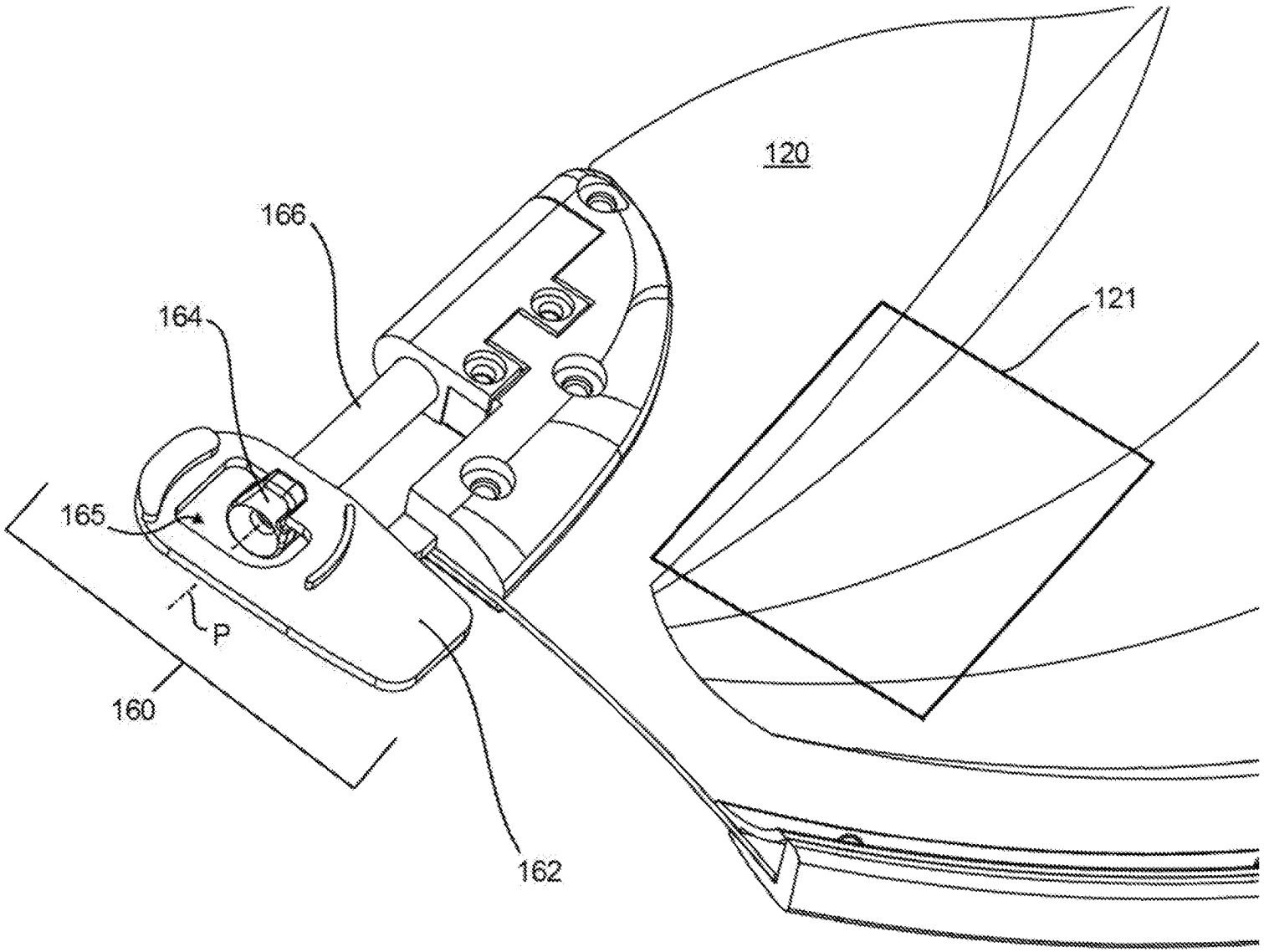
FIG. 11 is a close up view of the proximal end of a fan blade showing the blade pitch mechanism.
Figure 12:
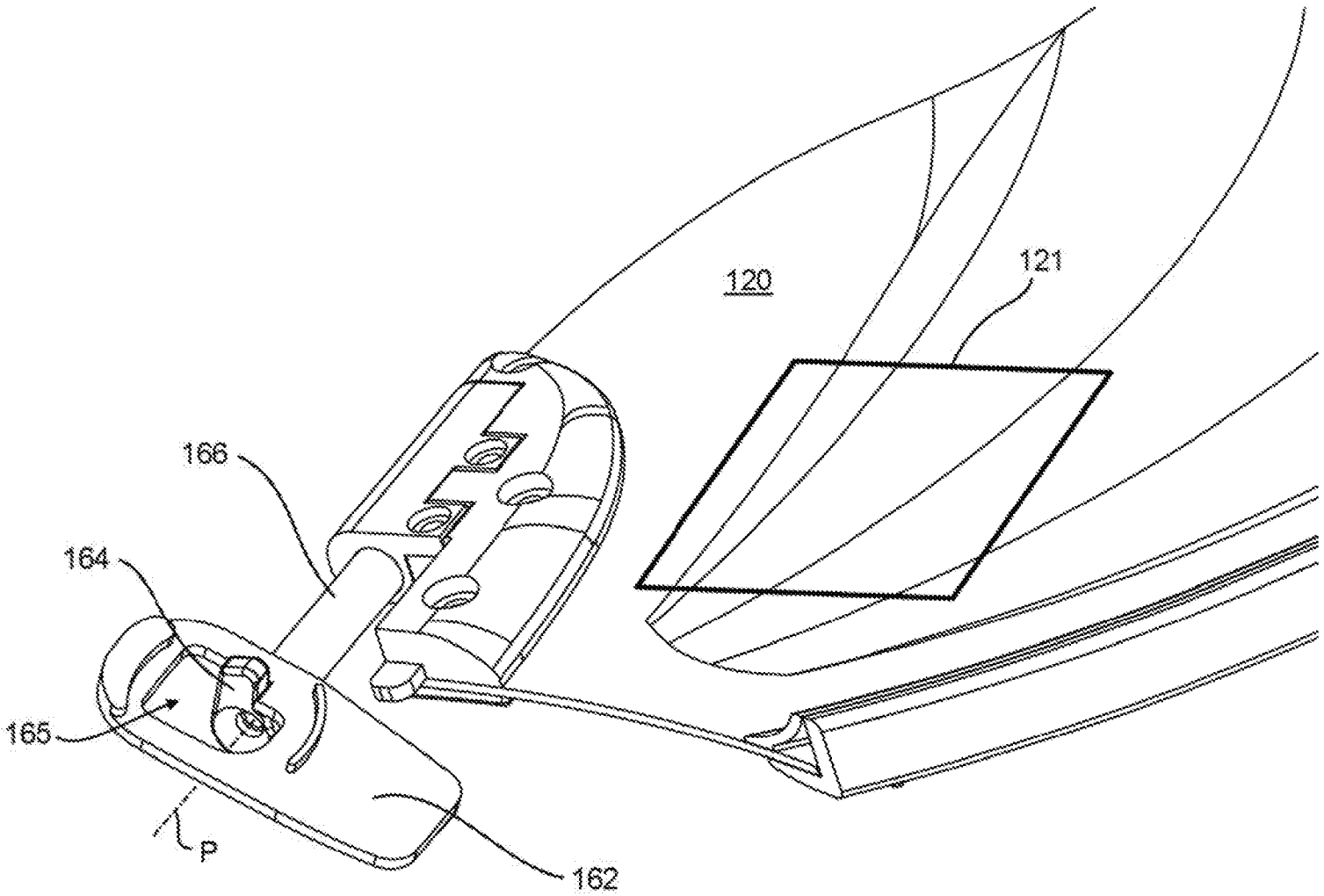
FIG. 12 shows the embodiment in FIG. 11 with the fan blade pitched up.

FIGS. 11 and 12 show the basic blade pitch mechanism 160. A sliding blade tilt plate 162 engages a blade tilt cam 164. The blade tilt cam 164 is attached to a blade tilt shaft 166 that allows the blade 120 to rotate, or "pitch" on pitch axis P substantially perpendicular to the central axis A and blade pivot axis B. In this example, the blade tilt shaft 166 is attached to the proximal end 142 of the fan blade 120 at the trailing edge 154. The sliding blade tilt plate 162 is driven against the blade tilt cam 164 as the blade 120 is deployed, effectively increasing the pitch angle, or angle of attack, of the blade 120.

Figure 13:
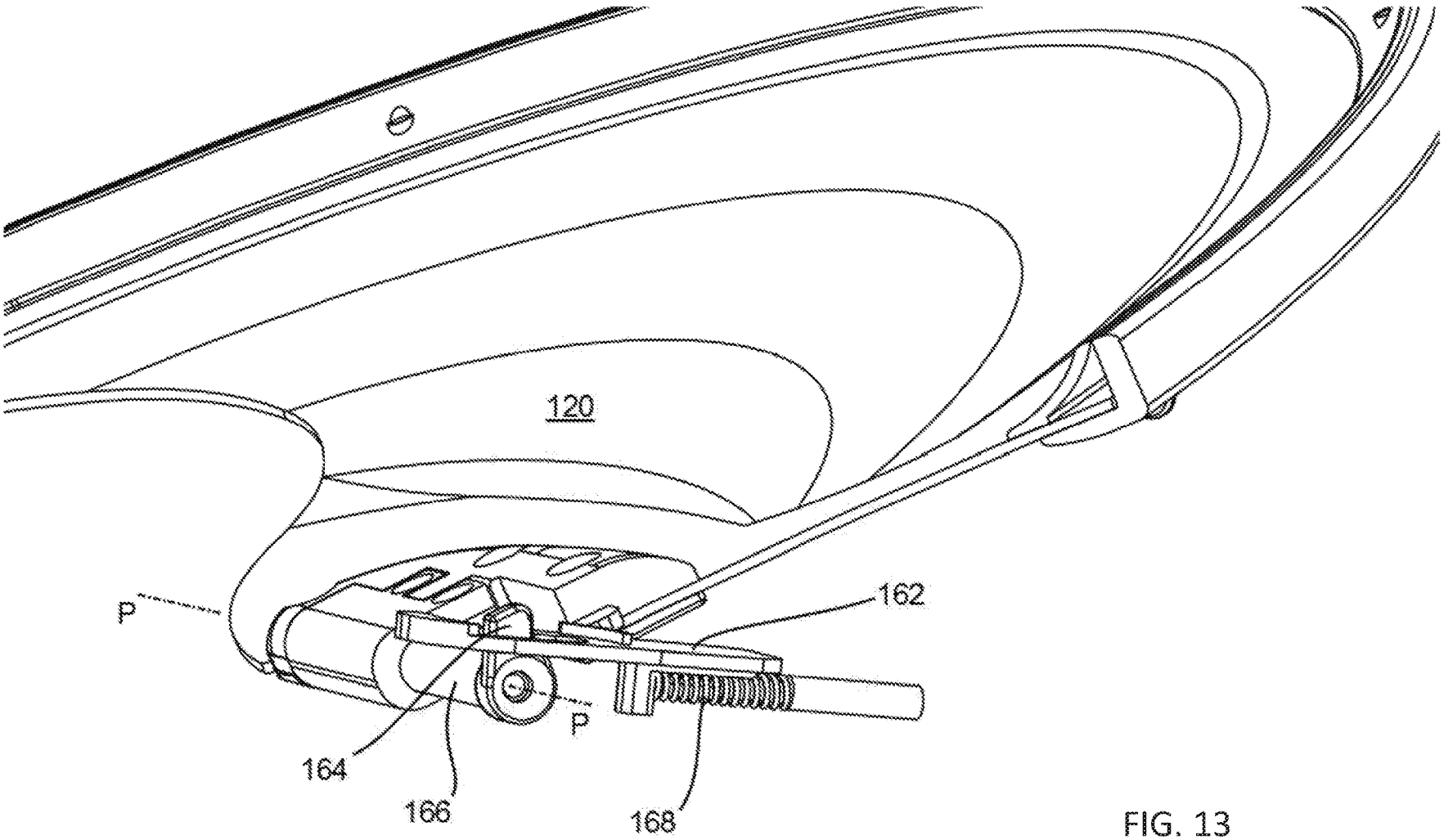
FIG. 13 shows another view of the fan blade pitched up.

In many embodiments, the fan blade 120 is not mounted at its center of mass on the blade tilt shaft 166. Thus some force may be required to push the blade tilt plate 162 and pitch the fan blade to the "up" position where it can move air. In the preferred embodiment, a spring 168 is provided to assist the blade tilt plate 162 movement. FIG. 13 shows how such a spring 168 is employed to reduce the force necessary to pitch the fan blade 120 up.

In the preferred embodiment, the blade tilt plate 162 is actuated in the pitch "up" direction as the blade 120 is rotated out to the deployed position. Likewise the blade tilt plate 162 is actuated in the pitch "down" direction (against the spring 168) as the blade 120 is rotated into the stowed position inside the housing 138. Thus the blade 120 will be flat as it enters the housing 138 and will require minimal space.

It is desirable to pitch the blade 120 up slowly as it moves out of the housing 138. This is pleasing to the user and it also spreads the work of moving the blade 120 up over a larger motion of the linear actuator 102. For instance, if the blade 120 was to suddenly pitch up only at the very end of deployment travel, it would require higher force. In addition, experience has shown that spreading the pitch up movement over the whole blade deployment motion is also more accurate and repeatable as it reduces large movements over short distances. It is important to have accurate, repeatable blade pitch angle to ensure balance while the fan is running.

The preferred embodiment utilizes an eccentric cam 170 arrangement on a blade mount plate 172 that interacts with the blade tilt plate 162 to cause the fan blade 120 to pitch up and down. The blade tilt plate 162 has two opposing drive faces 163*a*, 163*b*. The drive faces 163*a*, 163*b* are curved toward each other and spaced apart sufficiently to allow the eccentric cam 170 to reside in the space between the drive faces 163*a*, 163*b*. In between the drive faces 163*a*, 163*b* is a hole 165 through which the blade tilt cam 164 can protrude.

The blade mount plate 172 may be rigidly fixed to the fan plate 124. The blade tilt plate 162 is mounted to the blade mount plate 172 such that the eccentric cam 170 engages the drive faces 163*a*, 163*b* of the blade tilt plate 162 as the blade tilt plate 162 rotates about the eccentric cam 117. The eccentric cam 170 causes the blade tilt plate 162 to slide linearly, for example, perpendicular to the pitch axis P.

Figure 14:
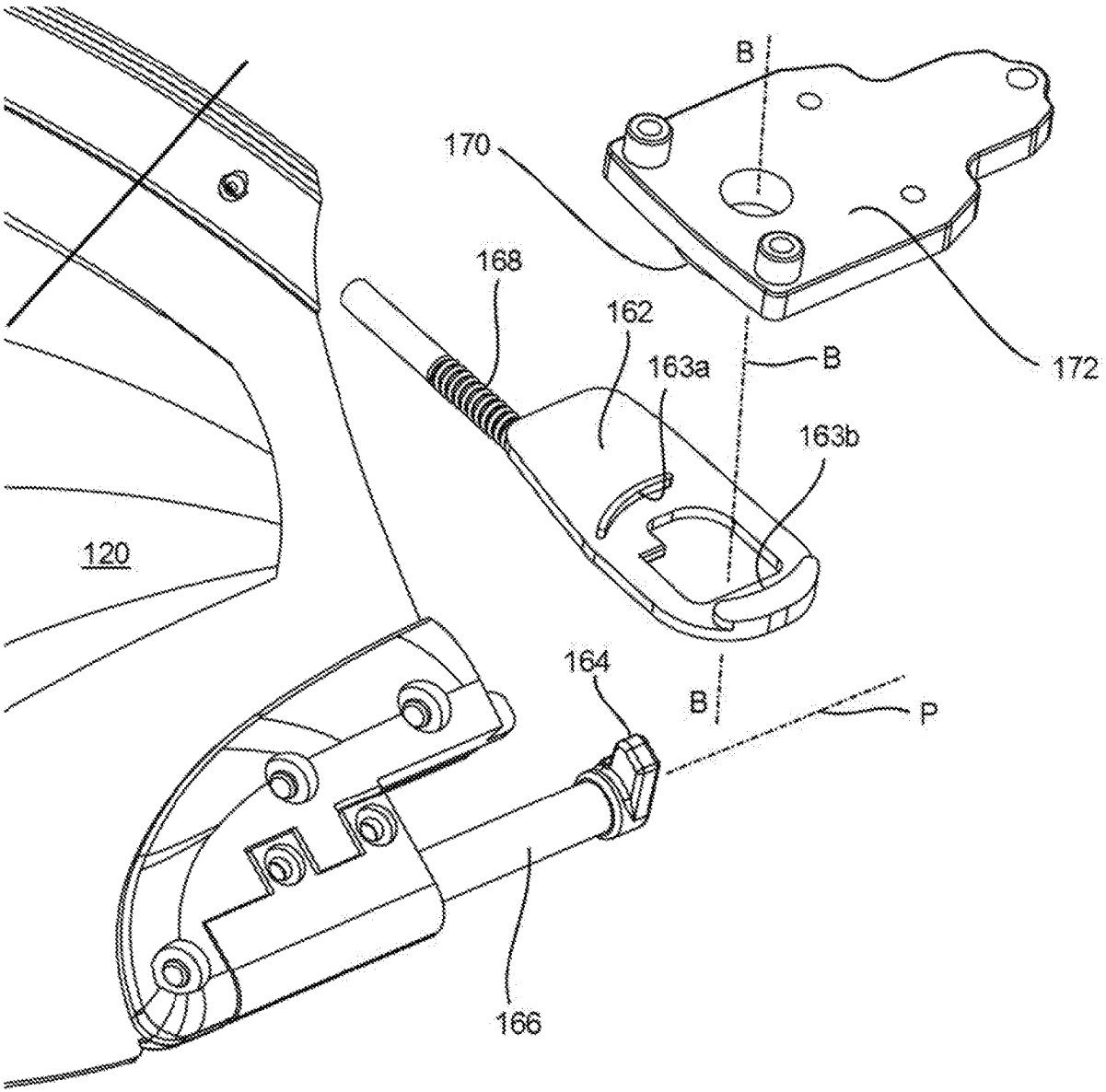
FIG. 14 shows a top, perspective, exploded view of components of the blade pitch mechanism.
Figure 15:
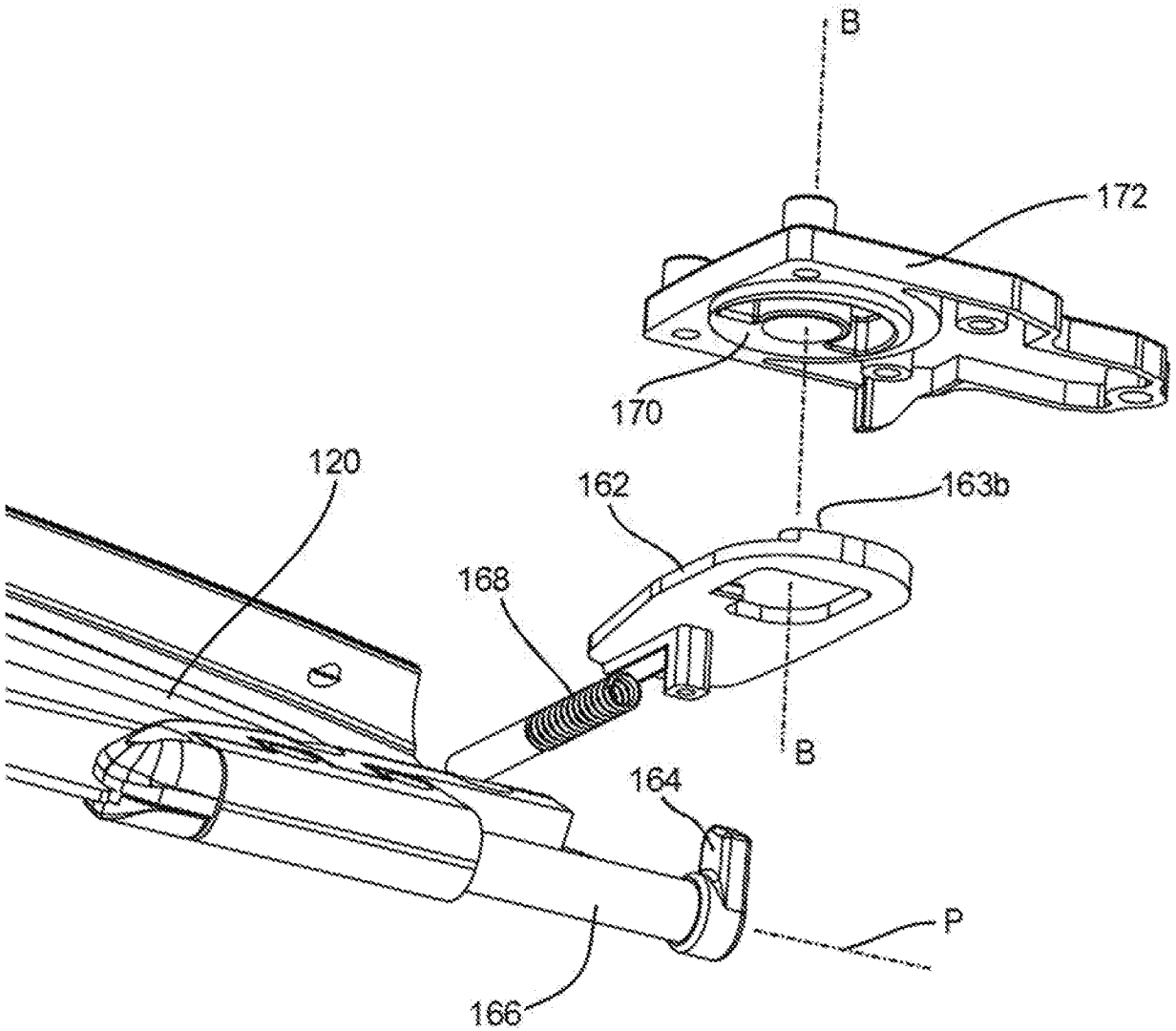
FIG. 15 shows a bottom, perspective, exploded view of components of the blade pitch mechanism.

Therefore, as the fan blade 120 moves from a stowed configuration to a deployed configuration, the blade tilt plate 162 rotates about the fan blade pivot axis B, while the blade mount plate 172 remains fixed relative to the fan plate 124. This causes the drive face 163*b* to engage the eccentric cam 170 and the eccentricity of the cam 170 forces the blade tilt plate 162 to move in a linear direction. Linear movement of the blade tilt plate 162 causes the blade tilt plate 162 to push against blade tilt cam 164 causing the blade tilt cam 164 to rotate about the pivot axis P. Rotation of the blade tilt cam 164 causes the blade tilt shaft 166 to rotate about the pivot axis P, which in turn causes the fan blade 120 to rotate and causes the leading edge 152 to move upwardly higher than the trailing edge 154 (pitched up). A spring 168 is positioned against the blade tilt plate 162 to facilitate this upward movement. In moving back to the stowed configuration, the blade tilt plate 162 rotates about the blade pivot axis B in the opposite direction causing a second drive face 163*a* to engage the eccentric cam 170. This causes the blade tilt plate 162 to move in the opposite linear direction causing the blade tilt cam 164 to rotate about the pitch axis P in the opposite direction, causing the blade tilt shaft to rotate about the pitch axis P in the opposite direction, which in turn causes the leading edge 152 of the fan blade 120 to lower into the same general plane as the trailing edge 154 (pitch down). This provides a smooth pitch movement of the blade 120 over its entire 180 degree deployment. FIGS. 14-15 show the eccentric cam 170 arrangement on the blade mount plate 172, which fixes the blade to the main rotating fan plate via the blade tilt shaft 166. In FIGS. 14-15, the blade 120 has rotated to its full deployed position and the eccentric cam 170 drives blade tilt plate 162 via drive face 163*b* to the deployed position. The blade assembly is thus moved to its fully pitched up position (with the help of the spring 168), via blade tilt cam 164 and blade tilt shaft 166. In this example, the spring 168 biases against the blade tilt plate 162 to slide the blade tile plate 162 linearly in a direction that causes the fan blade 120 to pitch upwardly. Therefore, as the fan blade 120 is deployed, the spring 168 assists in pitching the blade upwardly.

Figure 16:
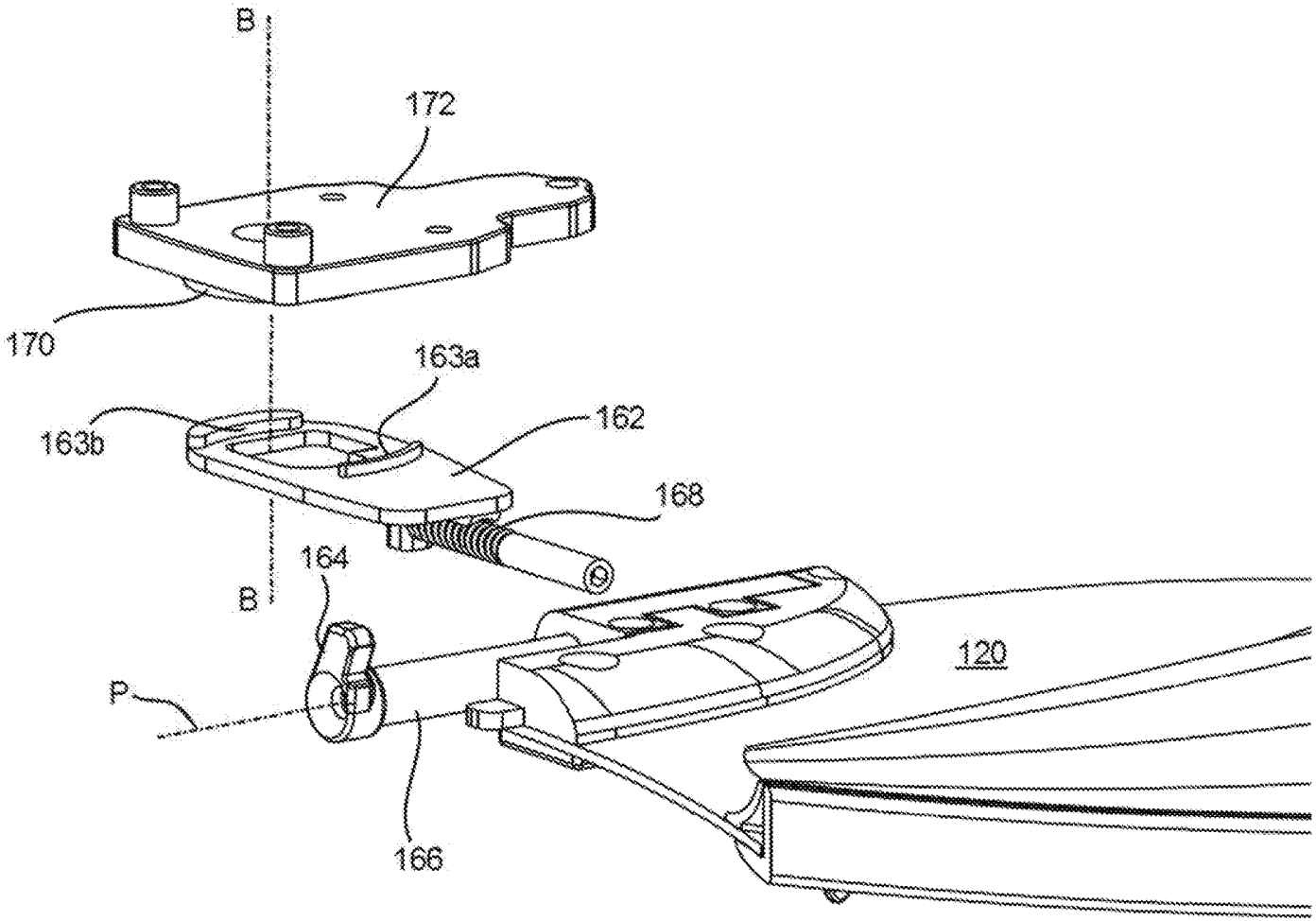
FIG. 16 shows a top, perspective, exploded view of components of the blade pitch mechanism.
Figure 17:
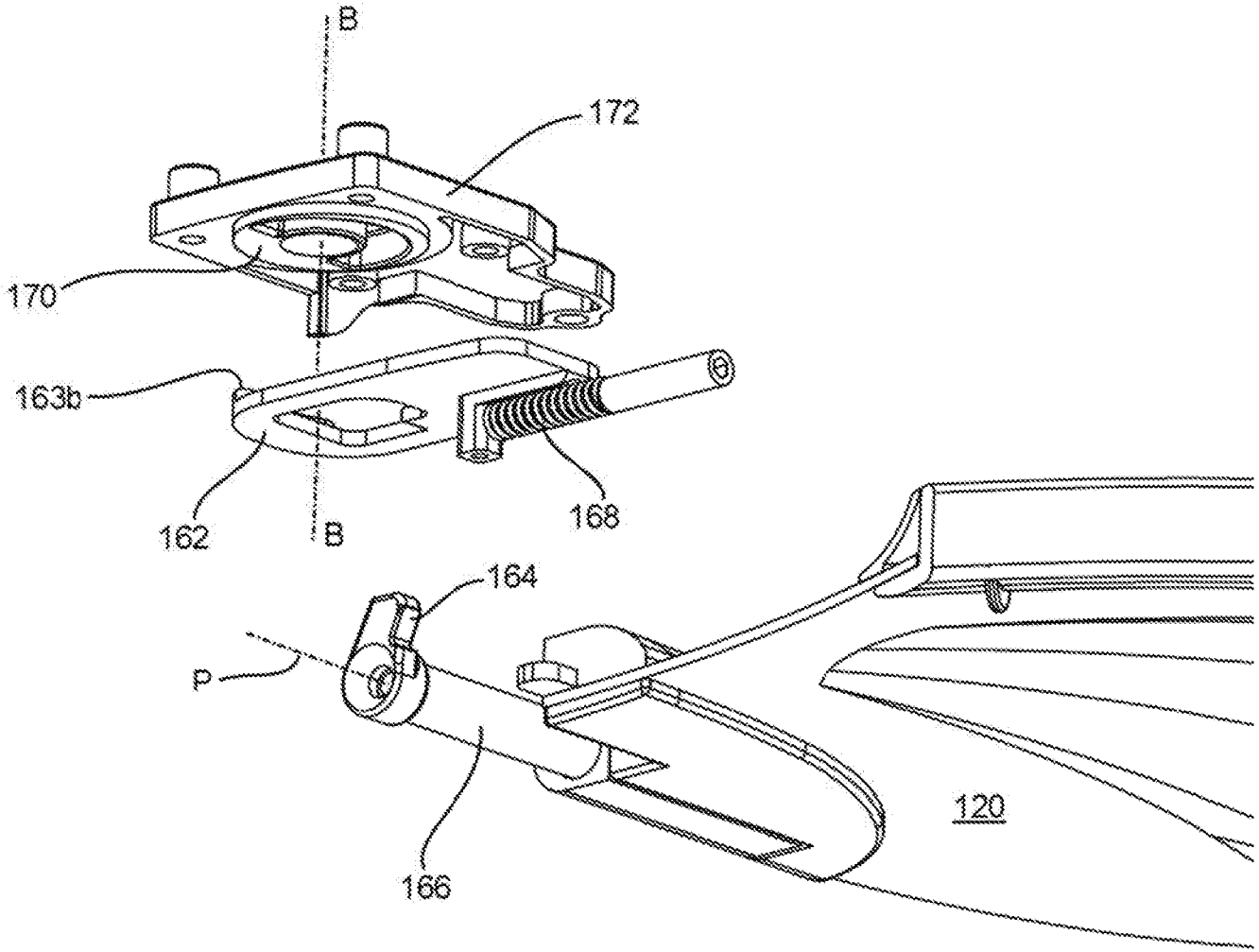
FIG. 17 shows a bottom, perspective, exploded view of components of the blade pitch mechanism.

In FIGS. 16-17, the blade 120 has rotated back to its stowed and pitched flat position. In the preferred embodiment, the weight of the blade 120 works with the eccentric cam 170 and drive face 163*a* of blade tilt plate 162 (against the spring 168) to bring the blade pitch to a "zero" or flat position for storage inside the housing 138. This is accomplished slowly by the eccentric cam 170 over the full 180 degrees of blade rotation back into the housing 138.

Figure 18:
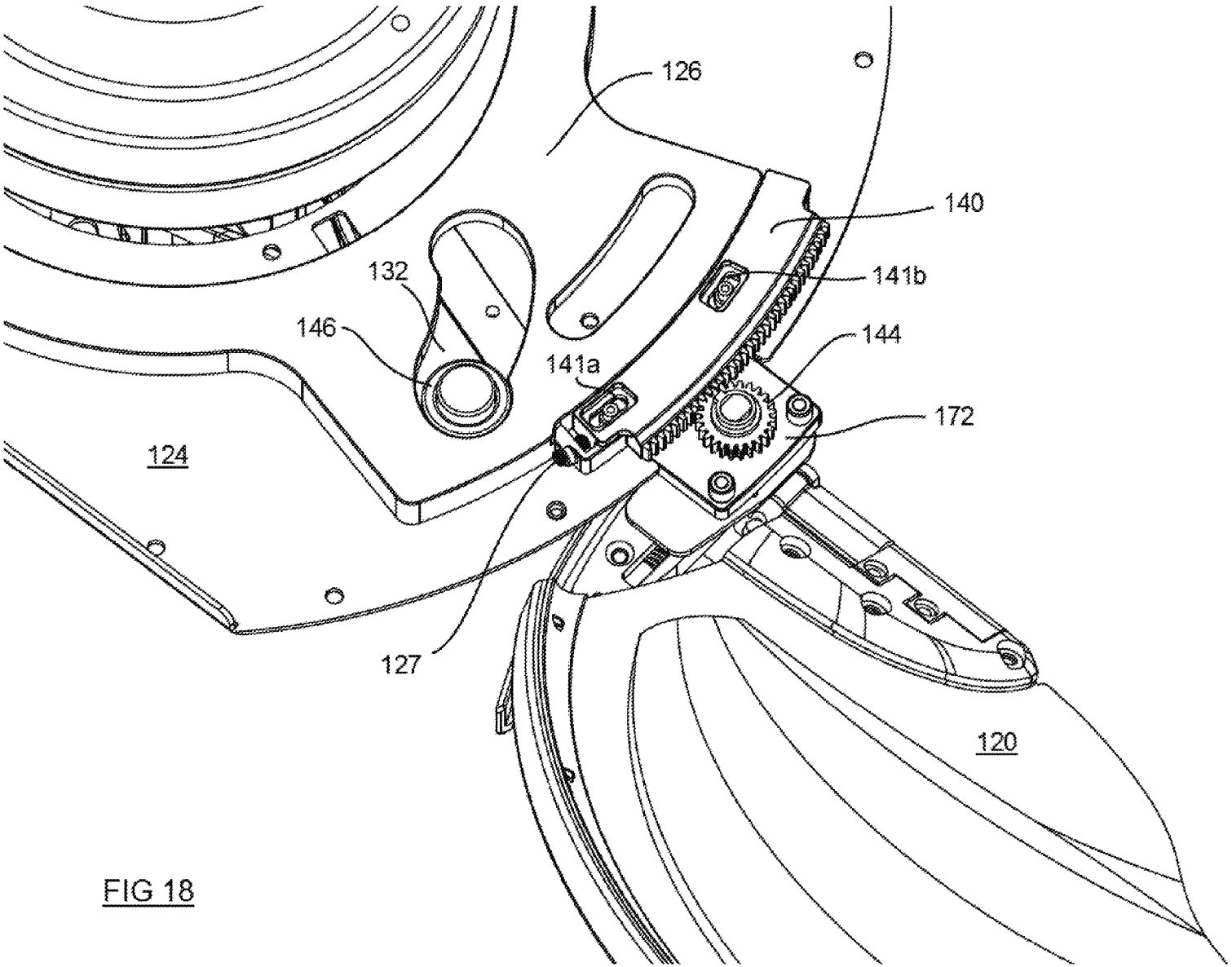
FIG. 18 shows a top view of the deployment and pitch mechanisms.
Figure 19:
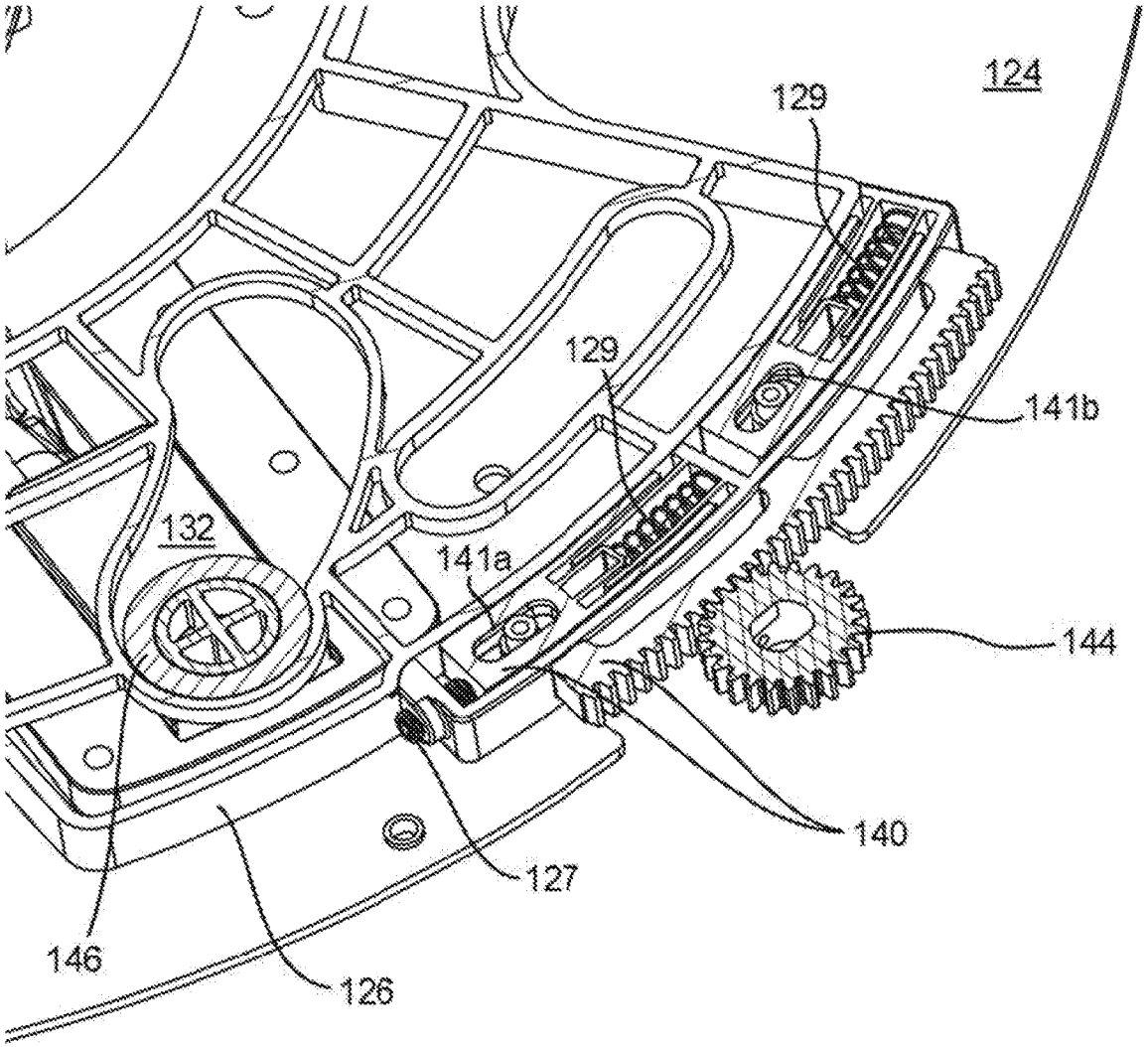
FIG. 19 shows a close-up view of an embodiment of the gear arrangement for the deployment and pitch mechanism.

In the preferred embodiment of the fan invention described herein, the blades 120 are provided with an adjustment for the fully deployed position. This adjustment is necessary to account for manufacturing tolerances. In FIG. 18, the position of sector gear 140 can be varied relative to rotary drive plate 126 via slots 141*a* and 141*b*. Varying the position of sector gear 140 causes an adjustment to spur gear 144, with resultant adjustment to the angular position of blade assembly 120. Set screw 127, mounted to rotary drive plate 126, provides this adjustment within the limits defined by slots 141*a* and 141*b*. In the preferred embodiment, each blade assembly 120 has its own set screw 127 for independent adjustment of the fully deployed position. In practice it is most important to secure proper adjustment of each blade assembly 120 in the fully deployed position. This ensures proper balance and function for the fan to move air. It is also desirable to ensure that each blade assembly 120 is fully retracted into housing 138 when in the stowed position. A fixed adjustment, such as provided by set screw 127 for the deployed position, is generally not practical for the stowed position of each blade 120. In order to best handle manufacturing tolerances and service wear, one or more resilient elements are provided for this purpose. FIG. 19 is a section view showing resilient elements 129 installed to automatically adjust the stowed position of a blade assembly 120.

As in FIG. 18, sector gear 140 is allowed to move relative to rotary drive plate 126 via slots 141*a* and 141*b*. Set screw 127 provides a fixed stop adjustment for the deployed direction of motion for blade assembly 120. When retracting the blade assembly 120 to the stowed position, sector gear 140 is urged to move away from set screw 127. One or more resilient elements, such as springs 129, are provided to limit this motion and provide tension for blade assembly 120 in the stowed position via gear 144. Each blade assembly 120 is provided with independent resilient elements 129, which enable automatic adjustment of the stowed position inside housing 138. Generally resilient elements 129 will have sufficient compression travel to take up wear over the life of the fan.

Linear actuator 102 is also generally configured with extra travel to allow compression of resilient elements 129. Note that elements are shown as springs in FIG. 19, but they may be made of other compressible materials such as rubber, etc. Other means of providing adjustment, such as extension springs, are also easily employed.

Figure 20:
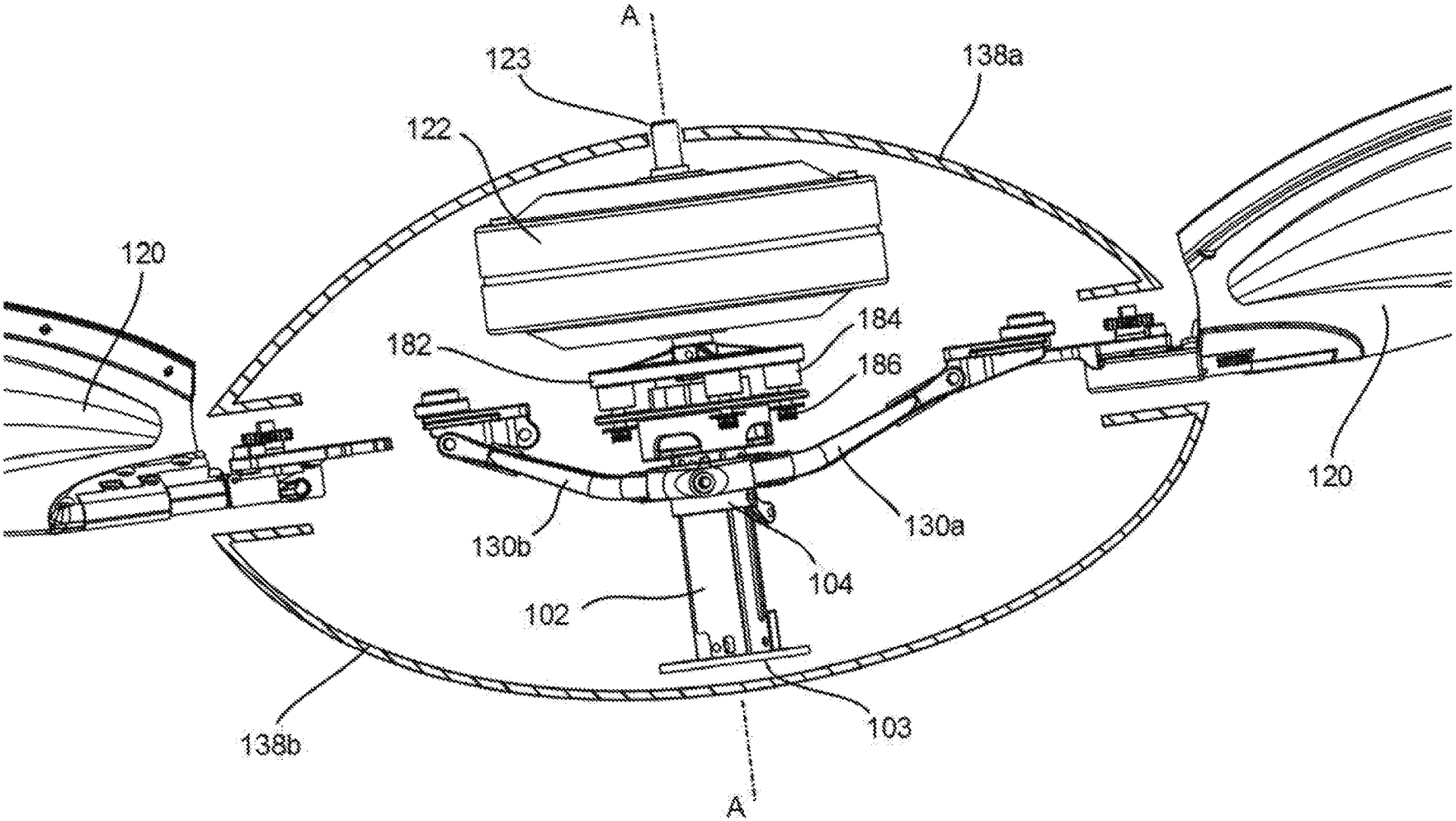
FIG. 20 shows a side view of the invention in the deployed configuration with the housing shown in cross-section.

In the general configuration of the preferred embodiment of fan 100, housing 138 has independent upper and lower sections, with blade assemblies 120 mounted in between. In FIG. 20, upper housing 138*a* is mounted to the upper end of stator shaft 123 of main fan motor 122. Lower housing 138*b* is mounted to the distal end 103 of actuator assembly 102. Actuator assembly 102 is mounted to the lower end of stator shaft 123 via mounting plate 182, so it does not rotate with main fan motor 122. A plurality of screws 186 are provided to fix the proximal end of actuator assembly 102 to mounting plate 182. In the general configuration, spacers 184 separate the proximal end of actuator assembly 102 from mounting plate 182. Thus the clearance between lower housing 138*b* and the stowed blade assemblies 120 may be adjusted. Spacers 184 may also be constructed of a resilient material, such as urethane rubber, to isolate noise while actuator 102 is operating.

In a more advanced configuration of fan 100, screws 186 may be configured with additional length relative to the length of spacers 184. This extra length allows the body of actuator 102 to move along main fan axis A, towards and away from mounting plate 182. Blade assemblies 120 and upper housing 138*a* are fixed so they cannot translate along main fan axis A. Since lower housing 138*b* is mounted to the distal end of actuator assembly 102, lower housing 138*b* may also translate along main fan axis A. This creates several design advantages for fan housing 138. For instance, lower housing 138*b* can be brought up close to blades 120 when blades 120 are stowed, but can move away for more clearance when blades 120 are deployed and running. In another configuration, lower housing 138*b* can be raised to completely cover the outside edges of blades 120 when they are in the stowed position. This would allow blades 120 to be totally concealed when not in use. The difference between the installed length of screws 186 and spacers 184 will determine the distance that lower housing 138*b* moves during operation.

Figure 21:
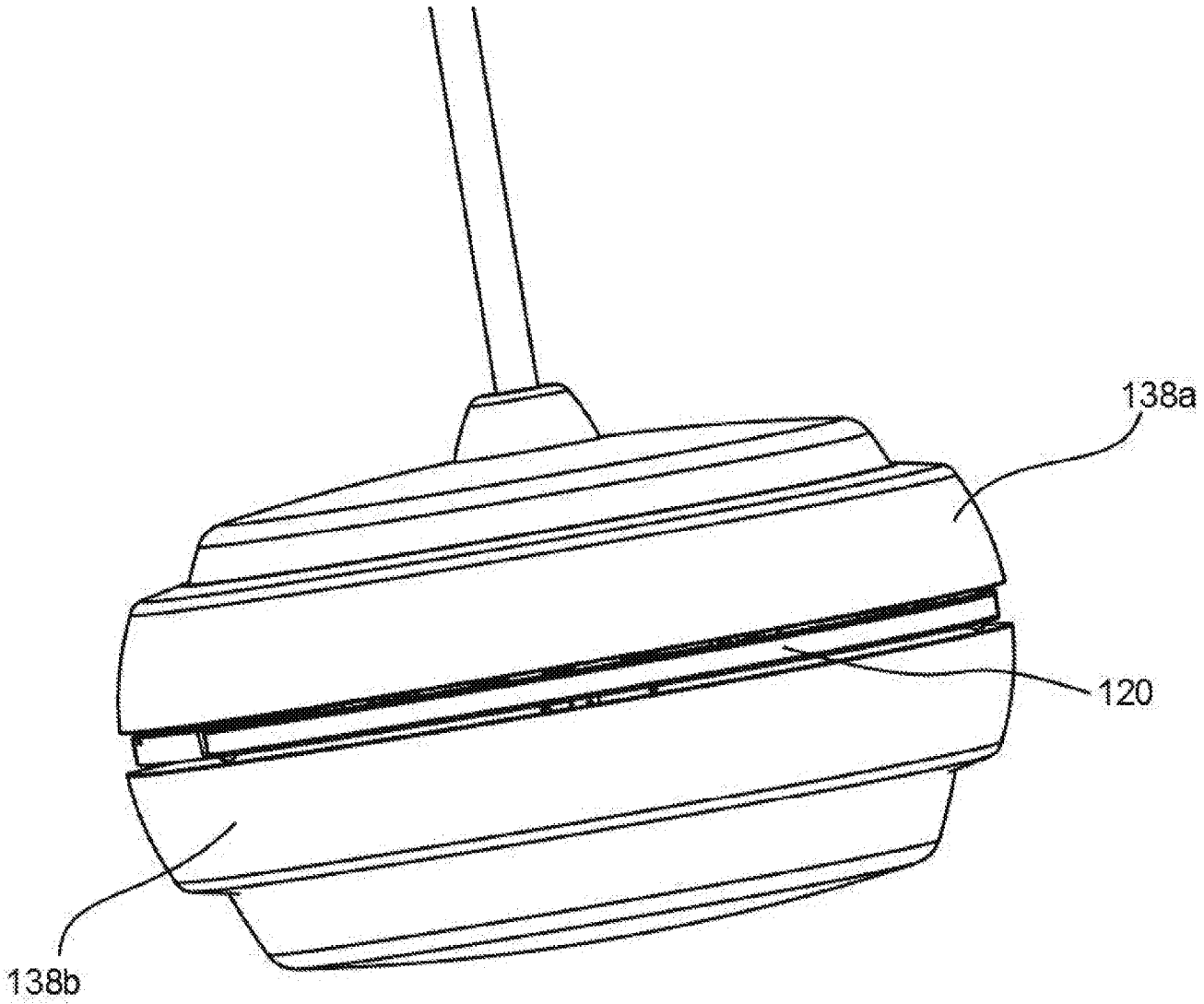
FIG. 21 shows a side view of the invention in the stowed configuration.
Figure 22:
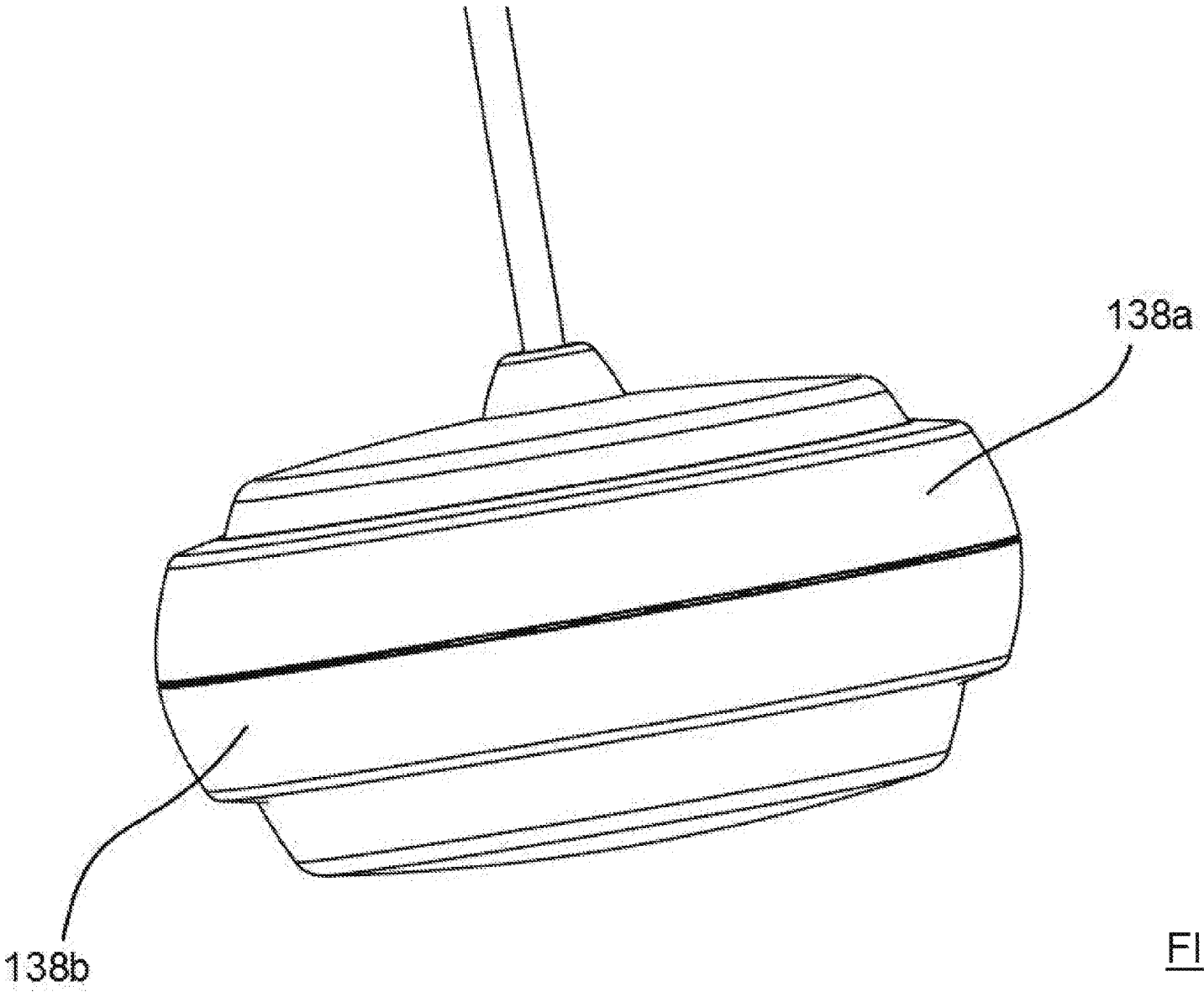
FIG. 22 shows a side view of the invention in the stowed configuration with the fan blades hidden.

The movable mounting of actuator 102 allows for automatic timing of the movements of blades 120 and lower housing 138*b*, without the need for additional actuators or controls. Referring to FIG. 20, with blades 120 in the fully deployed position, actuator 102 moves carriage 104 downward along axis A to begin retracting blades 120. During retraction, reaction force of deployment system 128 along axis A urges the body of actuator assembly 102 to move upwards toward mounting plate 182. Lower housing 138*b*, attached to actuator assembly 102, can be designed with sufficient weight to overcome this reaction force. Thus housing 138*b* will stay in the down position until blades 120 are in the fully stowed position. With deployment system 128 no longer able to move, carriage 104 will keep traversing downward along axis A and the body of actuator 102 (with lower housing 138*b* attached) will now be forced to move upward along axis A toward stowed blades 120. Therefore, in some embodiments, the fan blades 120 can be stowed within the housing 138 as shown in FIG. 21, or the fan blades can be completely hidden from as shown in FIG. 22. The limit of travel for actuator body 102 and lower housing 138*b* is defined by the length of spacers 184. Note that the timing effect of lower housing 138*b* can be enhanced by inserting one or more biasing elements, such as springs, between the proximal end of actuator assembly 102 and mounting plate 182. This would have the same effect as adding weight to lower housing 138*b*.

The automatic timing of the movement of lower housing 138*b* is similar during blade deployment. With blades 120 in the stowed position, actuator 102 and lower housing 138*b* is held against gravity in a proximal position relative to blades 120. As deployment of blades 120 starts, carriage 104 moves upward and relaxes the holding force. This allows gravity to translate actuator body 102 and lower housing 138*b* downward away from the stowed blades 120. Eventually actuator body 102 and lower housing 138*b* will reach a lower limit of travel defined by the length of screws 186. At this point carriage 104 continues its movement and deployment system 128 is forced to start deploying blades 120. Lower housing 138*b* at this point is well clear of the moving blades.

In the preferred embodiment of fan 100, a digital control system is provided to coordinate the movement of deployment system 128 with rotation of main fan motor 122. When fan 100 is not in use, it is generally desirable to have blades 120 in a stowed position inside housing 138. When a user commands fan 100 to turn on and operate, it is desirable to first deploy blades 120 and then start turning main fan motor 122. The digital control system inhibits the operation of main fan motor 122 until it has sensed that blades 120 are in a suitable deployed position. Likewise, when the user commands fan 100 to turn off, it is desirable to immediately cut power from main fan motor 122, and wait until fan 100 has slowed down to a suitable low speed before retracting the blades. The digital control system employs a tachometer sensor to inhibit retraction of the blades until fan 100 has slowed to desired speed, or even stopped turning.

The digital control system may also monitor the forces encountered during blade deployment and retraction, to detect one or more blades 120 striking an object or deployment system 128 binding. Likewise, retraction of blades 120 into housing 138 may create a pinching hazard for hands and fingers. The digital control system can be configured to monitor forces in deployment system 128 to detect pinching and immediately reverse the blade retraction.

In the preferred embodiment, actuator 102 is a stepper-type motor. The distance moved by such a stepper actuator may be monitored to adjust for wear in service and ensure full movement of deployment system 128 in both deployment and retraction.

In some embodiments, the basic steps for the control system to start fan 100 from an OFF configuration are: inhibit rotation of main fan motor 122, start actuator 102 in the DEPLOY direction, monitor distance traveled (steps) until blades 120 have deployed sufficiently, monitor force in deployment system 128 to detect blade strike or bind, start main fan motor 122 once blades 120 have deployed sufficiently, stop actuator 102 once blades 120 have fully deployed.

In some embodiments, the basic steps for the control system to stop fan 100 from an ON/RUNNING configuration are: immediately cut power to main fan motor 122, monitor rotational speed of main fan motor 122 via a tachometer sensor, inhibit actuator 102 until main fan motor 122 speed has dropped to a suitable level, start actuator 102 in the RETRACT direction once main fan motor 122 speed is suitably low, monitor distance traveled (steps) until blades 120 have reached the fully stowed position, monitor force in deployment system 128 to detect blade pinch or bind, stop actuator 102 once blades 120 have fully retracted.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A deployable fan, comprising:

a. a fan motor;

b. a fan platform defining a central axis, wherein the fan platform comprises a fan blade operatively connected to the fan motor to rotate the fan blade about the central axis, a fan plate operatively connected to the fan motor and operatively connected to the fan blade, and a rotary drive plate operatively connected to the fan plate and configured to rotate along a face of the fan plate;

c. a linear actuator mounted on a mounting plate along the central axis, wherein the linear actuator comprises: a motor; a shaft defining a longitudinal axis, wherein the motor is operatively connected to the shaft to rotate the shaft, and a driver mounted on the shaft, wherein rotation of the shaft in a first direction causes the driver to move in a first linear direction along the shaft, and rotation of the shaft in a second direction, opposite the first direction, causes the driver to move in a second linear direction along the shaft opposite the first linear direction;

d. a carriage operatively connected to the linear actuator and configured to move along the linear actuator along the central axis, wherein the carriage is operatively connected to the fan platform to convert movement of the carriage in the first linear direction into movement of the fan blade in a first radial direction away from the central axis, and to convert movement of the carriage in the second linear direction, opposite the first linear direction, into movement of the fan blade in a second radial direction towards the central axis;

e. a deployment system operatively connecting the fan blade to the carriage, wherein the deployment system comprises: an arm, wherein the arm comprises a first end and a second end opposite the first end, and a sliding block, the first end of the arm connected to the carriage and the second end of the arm connected to the sliding block, the sliding block operatively connected to the fan blade; the fan plate, and the rotary drive plate, wherein the sliding block is slidably connected to the fan plate such that linear movement of the carriage along the linear actuator causes the sliding block to move radially towards or away from the central axis within the fan plate, wherein the fan plate comprises a fan plate drive slot, the rotary drive plate comprises a rotary plate drive slot, and the sliding block comprises a drive roller, wherein the fan plate drive slot is linear and the rotary drive plate drive slot has an offset configuration relative to the fan plate drive slot, wherein the rotary drive plate is operatively connected to the fan plate so that only a portion of the rotary plate drive slot overlaps with a portion of the fan plate drive slot, and the drive roller is inserted through the fan plate drive slot and the rotary plate drive slot;

f. a blade pivot axis at a proximal end of the fan blade;

g. a sector gear mounted to the rotary drive plate at a periphery of the rotary driver plate;

h. a spur gear positioned at the proximal end of the fan blade and operatively connected to the fan blade so that rotation of the spur gear causes rotation of the fan blade about the blade pivot axis, wherein rotation of the spur gear in a first direction rotates the fan blade about the blade pivot axis in a first rotational direction causing the fan blade to deploy, and rotation of the spur gear in a second direction, opposite the first direction, causes the fan blade to rotate about the blade pivot axis in a second rotational direction, opposite the first rotational direction, causing the fan blade to move towards a stowed configuration, wherein the sliding block resides in the fan plate drive slot to move linearly within the fan plate drive slot in a direction radially towards or away from the central axis, and the drive roller resides in the rotary plate drive slot to move about the rotary plate drive slot, wherein linear movement of the sliding block along the fan plate drive slot causes linear movement of the drive roller along the fan plate drive slot, and wherein linear movement of the driver roller along the fan plate drive slot causes rotation of the rotary drive plate in order to keep a portion of the rotary plate drive slot aligned with the fan plate drive slot, wherein rotation of the rotary drive plate causes movement of the sector gear relative to the spur gear, wherein movement of the sector gear causes rotation of the spur gear, and wherein rotation of the spur gear causes the fan blade to rotate about the blade pivot axis, wherein a position of the sector gear is variable relative to the rotary drive plate, wherein the fan platform further comprises a resilient element biased against the sector gear to automatically adjust the stowed position of a fan blade;

i. a blade pitch mechanism to adjust a pitch of the blade, wherein the blade pitch mechanism comprises: a sliding blade tilt plate configured to slide in a linear direction, a blade tilt cam operatively connected to the sliding blade tilt plate, wherein movement in the linear direction of the sliding blade tilt plate causes rotational movement of the blade tilt cam, a blade tilt shaft defining a pitch axis, the blade tilt shaft operatively connected to the blade tilt cam to rotate with the blade tilt cam, the blade tilt shaft operatively connected to the fan blade to rotate the fan blade, and a blade mount plate comprising an eccentric cam operatively connected to the sliding blade tilt plate, wherein rotational movement of the sliding blade tilt plate about the eccentric cam causes the sliding blade tilt plate to slide in the linear direction, wherein the blade pitch mechanism further comprises a spring biased against the sliding blade tilt plate to facilitate the sliding movement in one linear direction.

2. A deployable fan, comprising a. a fan motor;

b. a fan platform defining a central axis, the fan platform, comprising a fan blade operatively connected to the fan motor to rotate the fan blade about the central axis;

c. a linear actuator mounted on a mounting plate along the central axis; and d. a carriage operatively connected to the linear actuator and configured to move along the linear actuator along the central axis, e. a deployment system operatively connecting the fan blade to the carriage, wherein the deployment system comprises an arm and a sliding block, wherein the arm comprises a first end and a second end opposite the first end, the first end of the arm connected to the carriage and the second end of the arm connected to the sliding block, the sliding block operatively connected to the fan blade, wherein the carriage is operatively connected to the fan platform to convert movement of the carriage in a first linear direction into movement of the fan blade in a first radial direction away from the central axis, and to convert movement of the carriage in a second linear direction, opposite the first linear direction, into movement of the fan blade in a second radial direction towards the central axis, wherein the fan platform comprises a fan plate operatively connected to the fan motor and operatively connected to the fan blade, and a rotary drive plate operatively connected to the fan plate and configured to rotate along a face of the fan plate, wherein the sliding block is operatively connected to the fan plate and the rotary drive plate, wherein the sliding block is slidably connected to the fan plate such that linear movement of the carriage along the linear actuator causes the sliding block to move radially towards or away from the central axis within the fan plate, wherein the fan plate comprises a fan plate drive slot, the rotary drive plate comprises a rotary plate drive slot, and the sliding block comprises a drive roller, wherein the fan plate chive slot is linear and the rotary drive plate drive slot has an offset configuration relative to the fan plate drive slot.

3. The deployable fan of claim 2, wherein the rotary drive plate is operatively connected to the fan plate so that only a portion of the rotary plate drive slot overlaps with a portion of the fan plate drive slot, and the drive roller is inserted through the fan plate drive slot and the rotary plate drive slot.

4. The deployable fan of claim 3, further comprising:

a. a blade pivot axis at a proximal end of the fan blade;

b. a sector gear mounted to the rotary drive plate at a periphery of the rotary driver plate, c. a spur gear positioned at the proximal end of the fan blade and operatively connected to the fan blade so that rotation of the spur gear causes rotation of the fan blade about the blade pivot axis, wherein rotation of the spur gear in a first direction rotates the fan blade about the blade pivot axis in a first rotational direction causing the fan blade to deploy, and rotation of the spur gear in a second direction, opposite the first direction, causes the fan blade to rotate about the blade pivot axis in a second rotational direction, opposite the first rotational direction, causing the fan blade to move towards a stowed configuration.

5. The deployable fan of claim 4, wherein the sliding block resides in the fan plate drive slot to move linearly within the fan plate drive slot in a direction radially towards or away from the central axis, and the drive roller resides in the rotary plate drive slot to move about the rotary plate drive slot.

6. The deployable fan of claim 5, wherein linear movement of the sliding block along the fan plate drive slot causes linear movement of the drive roller along the fan plate drive slot, and wherein linear movement of the driver roller along the fan plate drive slot causes rotation of the rotary drive plate in order to keep a portion of the rotary plate drive slot aligned with the fan plate drive slot, wherein rotation of the rotary drive plate causes movement of the sector gear relative to the spur gear, wherein movement of the sector gear causes rotation of the spur gear, and wherein rotation of the spur gear causes the fan blade to rotate about the blade pivot axis.

7. The deployable fan of claim 4, wherein a position of the sector gear is variable relative to the rotary drive plate.

8. The deployable fan of claim 7, wherein the fan platform further comprises a resilient element biased against the sector gear to automatically adjust the stowed position of a fan blade.

9. A deployable fan, comprising:

a. a fan motor;

b. a fan platform defining a central axis, the fan platform, comprising a fan blade operatively connected to the fan motor to rotate the fan blade about the central axis;

c. a linear actuator mounted on a mounting plate along the central axis;

d. a carriage operatively connected to the linear actuator and configured to move along the linear actuator along the central axis, wherein the carriage is operatively connected to the fan platform to convert movement of the carriage in a first linear direction into movement of the fan blade in a first radial direction away from the central axis, and to convert movement of the carriage in a second linear direction, opposite the first linear direction, into movement of the fan blade in a second radial direction towards the central axis; and e. a blade pitch mechanism to adjust a pitch of the blade, wherein the blade pitch mechanism comprises:

(i) a sliding blade tilt plate configured to slide in a linear direction;

(ii) a blade tilt cam operatively connected to the sliding blade tilt plate, wherein movement in the linear direction of the sliding blade tilt plate causes rotational movement of the blade tilt cam;

(iii) a blade tilt shaft defining a pitch axis, the blade tilt shaft operatively connected to the blade tilt cam to rotate with the blade tilt cam, the blade tilt shaft operatively connected to the fan blade to rotate the fan blade; and (iv) a blade mount plate comprising an eccentric cam operatively connected to the sliding blade tilt plate, wherein rotational movement of the sliding blade tilt plate about the eccentric cam causes the sliding blade tilt plate to slide in the linear direction.

10. The deployable fan of claim 9, wherein the blade pitch mechanism further comprises a spring biased against the sliding blade tilt plate to facilitate the sliding movement in one linear direction.

* * * * *